US011433666B2

(12) United States Patent
Nakagawa et al.

(10) Patent No.: US 11,433,666 B2
(45) Date of Patent: Sep. 6, 2022

(54) LIQUID EJECTION HEAD, LIQUID EJECTION APPARATUS, AND LIQUID EJECTION MODULE

(71) Applicant: CANON KABUSHIKI KAISHA, Tokyo (JP)

(72) Inventors: Yoshiyuki Nakagawa, Kawasaki (JP); Akiko Hammura, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 92 days.

(21) Appl. No.: 16/944,274

(22) Filed: Jul. 31, 2020

(65) Prior Publication Data

US 2021/0031514 A1 Feb. 4, 2021

(30) Foreign Application Priority Data

Aug. 1, 2019 (JP) ..... JP2019-142443

(51) Int. Cl.
*B41J 2/14* (2006.01)
*B41J 2/045* (2006.01)
*B41J 2/18* (2006.01)

(52) U.S. Cl.
CPC ..... *B41J 2/14016* (2013.01); *B41J 2/0458* (2013.01); *B41J 2/18* (2013.01)

(58) Field of Classification Search
CPC ..... B41J 2/14016; B41J 2/0458; B41J 2/18
See application file for complete search history.

(56) References Cited

U.S. PATENT DOCUMENTS 9,498,963 B2 11/2016 Yamasaki et al.
2019/0009544 A1 1/2019 Nakagawa et al.
2020/0039210 A1 2/2020 Nakagawa et al.
2020/0039218 A1 2/2020 Nakagawa et al.
2020/0039219 A1 2/2020 Nakagawa et al.
2020/0039223 A1 2/2020 Nakagawa et al.
2020/0262200 A1 8/2020 Nakagawa et al.
2020/0262201 A1 8/2020 Nakagawa et al.

FOREIGN PATENT DOCUMENTS

CN 105415886 A 3/2016
CN 110774759 A 2/2020
CN 110774760 A 2/2020
(Continued)

OTHER PUBLICATIONS

Extended European Search Report dated Dec. 4, 2020, in European Patent Application No. 20187944.2.
(Continued)

*Primary Examiner* — Thinh H Nguyen
(74) *Attorney, Agent, or Firm* — Venable LLP

(57) ABSTRACT

A liquid ejection head includes a liquid channel through which a first liquid and a second liquid flow, a pressure generation element that pressurizes the first liquid and an ejection orifice through which to eject the second liquid in a direction crossing a direction of the flow of the first liquid and the second liquid via the pressurization. A distance in the direction of the flow from a position in the liquid channel at which the first liquid and the second liquid merge to the ejection orifice is greater than an interface stabilization distance in the direction of the flow from a position at which the first liquid and the second liquid contact each other to a position at which a stable interface is obtained between the first liquid and the second liquid.

14 Claims, 12 Drawing Sheets

(56) References Cited

FOREIGN PATENT DOCUMENTS

| | | | |
|---|---|---|---|
| CN | 111572199 | A | 8/2020 |
| EP | 3 603 978 | A1 | 2/2020 |
| EP | 3 603 979 | A1 | 2/2020 |
| EP | 3 698 971 | A1 | 8/2020 |
| JP | 06-305143 | A | 11/1994 |
| WO | 2018/193446 | A1 | 10/2018 |

OTHER PUBLICATIONS

U.S. Appl. No. 16/944,266, Yoshiyuki Nakagawa Akiko Hammura Shinji Kishikawa, filed Jul. 31, 2020.
Office Action dated Apr. 1, 2022, in Chinese Patent Application No. 202010744248.4.

LIQUID EJECTION HEAD, LIQUID EJECTION APPARATUS, AND LIQUID EJECTION MODULE

BACKGROUND OF THE INVENTION

Field of the Invention

The present disclosure relates to a liquid ejection head, a liquid ejection apparatus, and a liquid ejection module.

Description of the Related Art

Japanese Patent Laid-Open No. H06-305143 discloses a liquid ejection unit in which a liquid as an ejection medium and a liquid as a bubble generation medium are brought into contact with each other at an interface and the ejection medium is ejected by means of growth of a bubble generated in the bubble generation medium by applying thermal energy. According to Japanese Patent Laid-Open No. H06-305143, a method is described in which, after the ejection of the ejection medium, the ejection medium and the bubble generation medium are pressurized to form a flow so as to make the interface between the ejection medium and the bubble generation medium stable inside a liquid channel.

SUMMARY OF THE DISCLOSURE

In a first aspect of the present invention, there is provided a liquid ejection head comprising: a liquid channel through which a first liquid and a second liquid flow; a pressure generation element that pressurizes the first liquid; and an ejection orifice through which to eject the second liquid in a direction crossing a direction of the flow of the first liquid and the second liquid via the pressurization, wherein a distance in the direction of the flow from a position in the liquid channel at which the first liquid and the second liquid merge to the ejection orifice is greater than an interface stabilization distance in the direction of the flow from a position at which the first liquid and the second liquid contact each other to a position at which a stable interface is obtained between the first liquid and the second liquid.

In a second aspect of the present invention, there is provided a liquid ejection apparatus comprising a liquid ejection head including a liquid channel through which a first liquid and a second liquid flow; a pressure generation element that pressurizes the first liquid; an ejection orifice through which to eject the second liquid in a direction crossing a direction of the flow of the first liquid and the second liquid via the pressurization; a flow control unit that controls the flow of the first liquid and the second liquid in the liquid channel; and a drive unit that drives the pressure generation element, wherein a distance in the direction of the flow from a position in the liquid channel at which the first liquid and the second liquid merge to the ejection orifice is greater than an interface stabilization distance in the direction of the flow from a position at which the first liquid and the second liquid contact each other to a position at which a stable interface is obtained between the first liquid and the second liquid.

In a third aspect of the present invention, there is provided a liquid ejection module that forms a liquid ejection head by being arrayed with one or more of the liquid ejection modules, comprising: a liquid channel through which a first liquid and a second liquid flow; a pressure generation element that pressurizes the first liquid; and an ejection orifice through which to eject the second liquid in a direction crossing a direction of the flow of the first liquid and the second liquid via the pressurization, wherein a distance in the direction of the flow from a position in the liquid channel at which the first liquid and the second liquid merge to the ejection orifice is greater than an interface stabilization distance in the direction of the flow from a position at which the first liquid and the second liquid contact each other to a position at which a stable interface is obtained between the first liquid and the second liquid.

Further features of the present disclosure will become apparent from the following description of exemplary embodiments with reference to the attached drawings.

DESCRIPTION OF THE EMBODIMENTS

In Japanese Patent Laid-Open No. H06-305143, there is a description about stabilization of the interface, but there is no clear description about the length (distance) of the interface required to perform a fine ejection operation and the positional relationship of the region where the interface is formed relative to the ejection orifice. Thus, although a stable interface can be formed in accordance with Japanese Patent Laid-Open No. H06-305143, the ejection operation may be unstable if that interface is not formed at a preferable position across a preferable length relative to the ejection orifice. This results in variation of the medium components contained in an ejected droplet and variation in ejection amount and ejection speed. Thus, there is a possibility that the quality of an output product obtained by applying the ejection medium may be impaired.

The present invention has been made to solve the above problem. Thus, an object of the present invention is to provide a liquid ejection head capable of maintaining a fine ejection operation by forming the interface between liquids that are caused to flow through a liquid channel at an appropriate position across an appropriate length relative to the ejection orifice.

First Embodiment (Configuration of Liquid Ejection Head)

Figure 1:
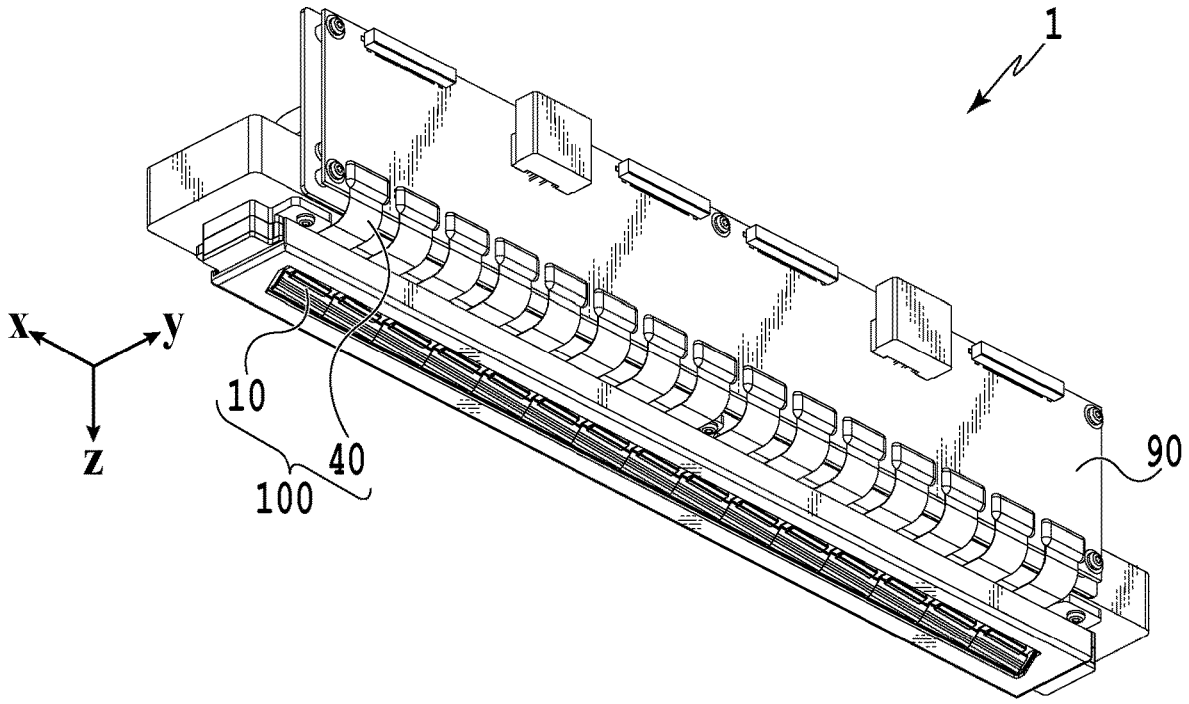
FIG. 1 is a perspective view of an ejection head.

FIG. 1 is a perspective view of a liquid ejection head 1 usable in a first embodiment. The liquid ejection head 1 in the present embodiment includes a plurality of liquid ejection modules 100 arrayed in an x direction. Each individual liquid ejection module 100 has an element substrate 10 in which a plurality of ejection elements are arrayed, and a flexible wiring substrate 40 for supplying power and an ejection signal to each individual ejection element. The flexible wiring substrates 40 are connected in common to an electrical wiring board 90 in which power supply terminals and ejection signal input terminals are disposed. The liquid ejection modules 100 are easily attachable to and detachable from the liquid ejection head 1. Thus, any liquid ejection modules 100 are easily attachable to and detachable from the liquid ejection head 1 from the outside without having to disassemble the liquid ejection head 1.

As described above, the liquid ejection head 1 includes a plurality of liquid ejection modules 100 arrayed in the longitudinal direction. Thus, even in a case where an ejection failure occurs in any of the election elements, only the liquid ejection module with the ejection failure needs to be replaced. This makes it possible to improve the yield of the manufacturing process of the liquid ejection head 1 and to reduce the cost of head replacement.

(Configuration of Liquid Ejection Apparatus)

Figure 2:
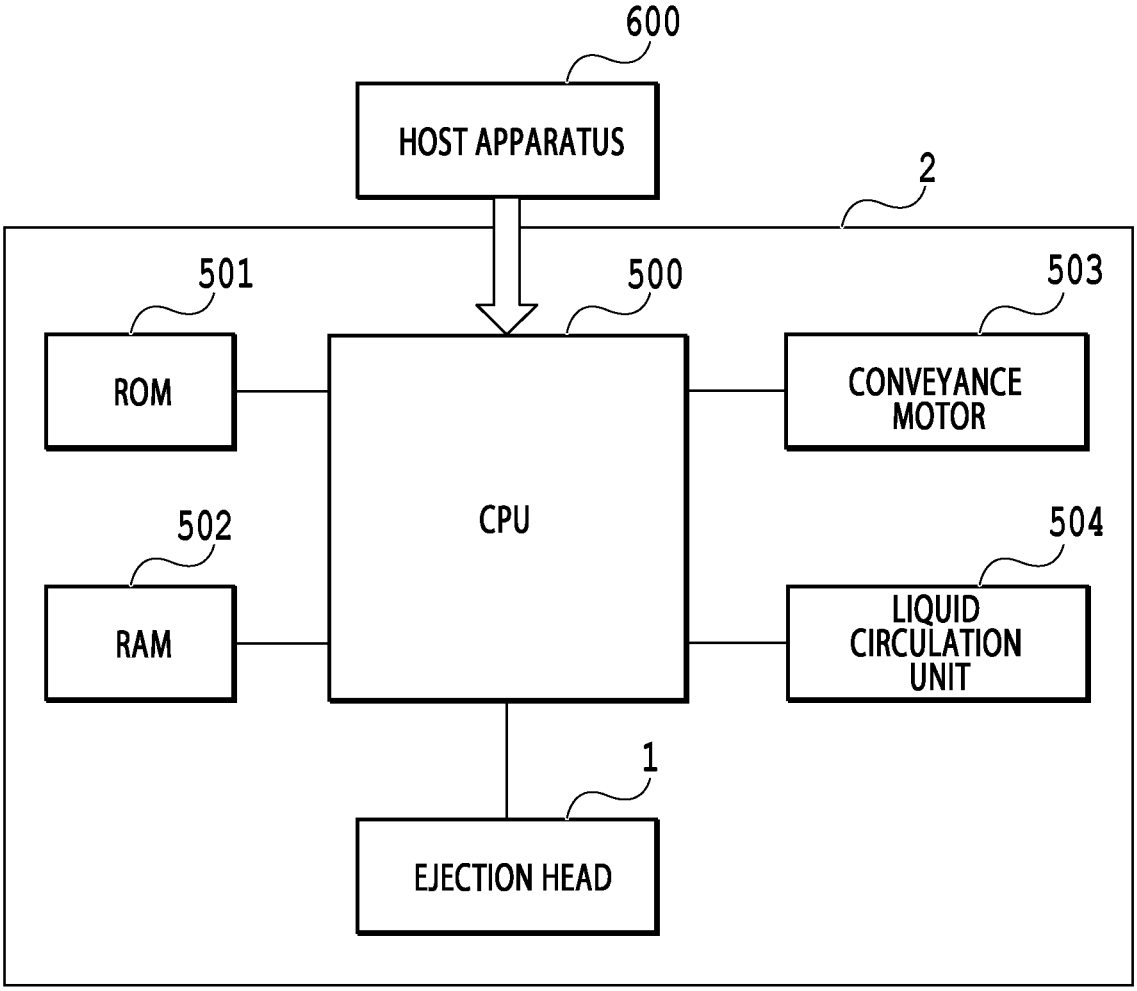
FIG. 2 is a block diagram for explaining a control configuration of a liquid ejection apparatus.

FIG. 2 is a block diagram illustrating a control configuration of a liquid ejection apparatus 2 usable in the present embodiment. A CPU 500 controls the entire liquid ejection apparatus 2 while using a RAM 502 as a work area in accordance with a program stored in a ROM 501. In an example, the CPU 500 performs predetermined data processing on ejection data received from a host apparatus 600 connected to the outside in accordance with the program and parameters stored in the ROM 501 to thereby generate ejection signals with which the liquid ejection head 1 can perform an ejection operation. Then, while driving the liquid ejection head 1 in accordance with this ejection signal, the CPU 500 drives a conveyance motor 503 to convey a liquid application target medium in a predetermined direction and thereby attach a liquid ejected from the liquid ejection head 1 to the application target medium.

A liquid circulation unit 504 is a unit that supplies liquids to the liquid ejection head 1 while circulating the liquids, and controls the flow of the liquids in the liquid ejection head 1. The liquid circulation unit 504 includes sub tanks which store the liquids, channels through which the liquids are circulated between the sub tanks and the liquid ejection head 1, a plurality of pumps, a flow rate adjustment unit which adjusts the flow rates of the liquids flowing through the ejection head 1, and so on. Under the instruction of the CPU 500, the liquid circulation unit 504 controls the above plurality of mechanisms such that the liquids flow through the liquid ejection head 1 at predetermined flow rates.

(Configuration of Element Substrate)

Figure 3:
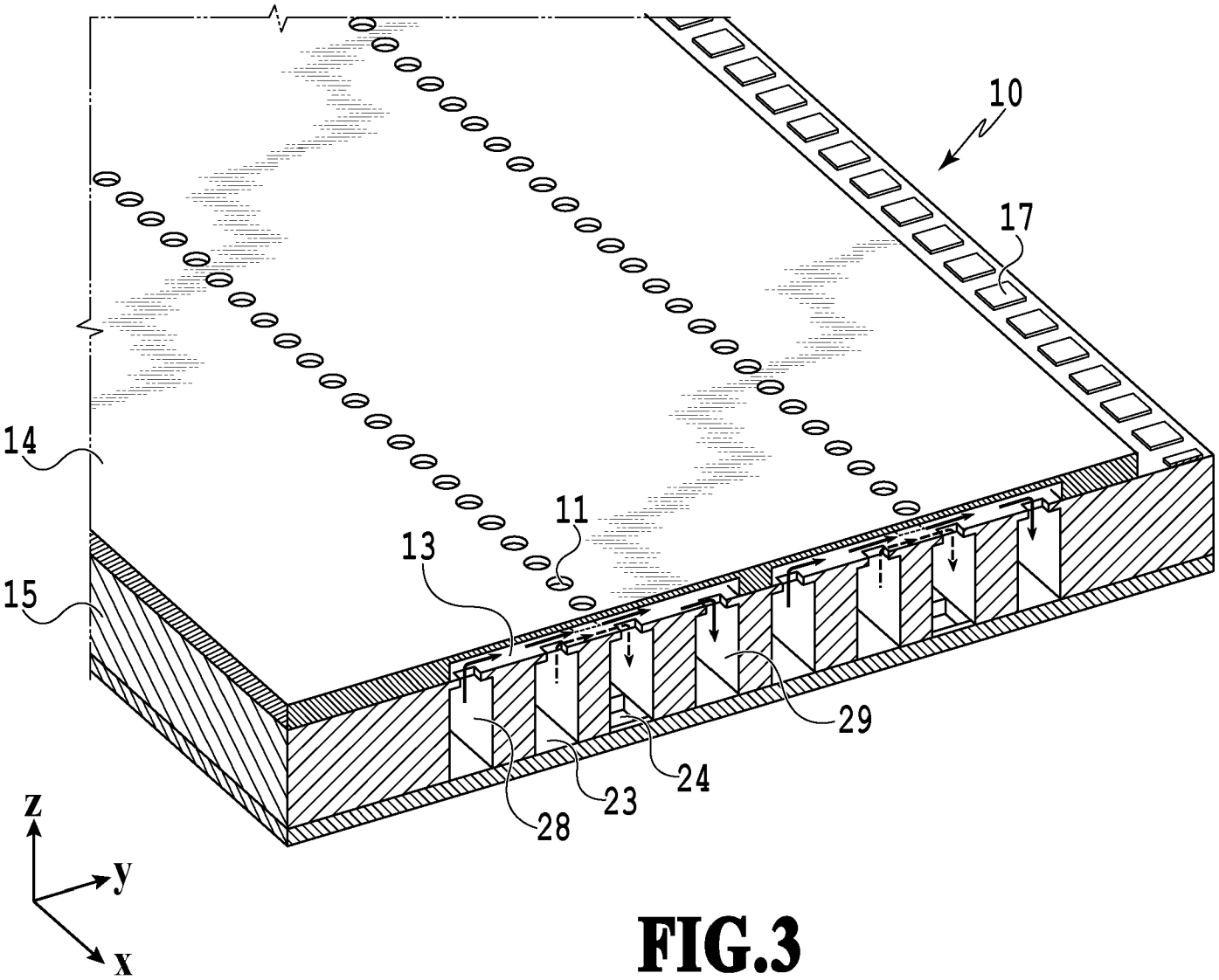
FIG. 3 is a perspective cross-sectional view of an element substrate in a liquid ejection module.

FIG. 3 is a perspective cross-sectional view of the element substrate 10 provided to each individual liquid ejection module 100. The element substrate 10 includes a silicon (Si) substrate 15 and an orifice plate 14 (ejection orifice forming member) laminated on the silicon substrate 15. In FIG. 3, ejection orifices 11 arrayed in the x direction eject the same kind of liquid (e.g., a liquid supplied from a common sub tank or supply port). Here, an example in which the orifice plate 14 also forms liquid channels 13 is shown. However, the configuration may be such that the liquid channels 13 are formed by another member (channel wall member), and the orifice plate 14 with the ejection orifices 11 formed therethrough is provided on top of that member.

Pressure generation elements 12 (not shown in FIG. 3) are disposed at positions on the silicon substrate 15 corresponding to the individual ejection orifices 11. The ejection orifices 11 and the pressure generation elements 12 are provided at positions opposite each other. Each pressure generation element 12 pressurizes a liquid in a z direction perpendicular to the flow direction (y direction) in a case where a voltage corresponding to an ejection signal is applied. As a result, the liquid is ejected in the form of a droplet from the ejection orifice 11 opposite the pressure generation element 12. The power and drive signal to the pressure generation element 12 are supplied from the flexible wiring substrate 40 (see FIG. 1) via a terminal 17 disposed on the silicon substrate 15.

In the orifice plate 14, a plurality of liquid channels 13 are formed which extend in the y direction and individually connect to the respective ejection orifices 11. Also, a plurality of liquid channels 13 arrayed in the x direction are connected in common to a first common supply channel 23, a first common collection channel 24, a second common supply channel 28, and a second common collection channel 29. The liquid flow in the first common supply channel 23, the first common collection channel 24, the second common supply channel 28, and the second common collection channel 29 is controlled by the liquid circulation unit 504 described with reference to FIG. 2. Specifically, the liquid flow is controlled such that a first liquid having flowed into the liquid channels 13 from the first common supply channel 23 flows toward the first common collection channel 24, and a second liquid having flowed into the liquid channels 13 from the second common supply channel 28 flows toward the second common collection channel 29.

FIG. 3 shows an example in which those ejection orifices 11 and liquid channels 13 arrayed in the x direction and the paired first and second common supply channels 23 and 28 and the paired first and second common collection channels 24 and 29 for supplying and collecting ink in common to and from the ejection orifices 11 and the liquid channels 13 are disposed in two rows in they direction. Note that although FIG. 3 shows the configuration in which the ejection orifices are disposed at positions opposite the pressure generation elements 12, i.e., in the direction of growth of bubbles, the present embodiment is not limited to this configuration. For example, the ejection orifices may be provided at positions perpendicular to the direction of growth of bubbles.

(Configuration of Liquid Channel and Pressure Chamber)

Figure 4A:
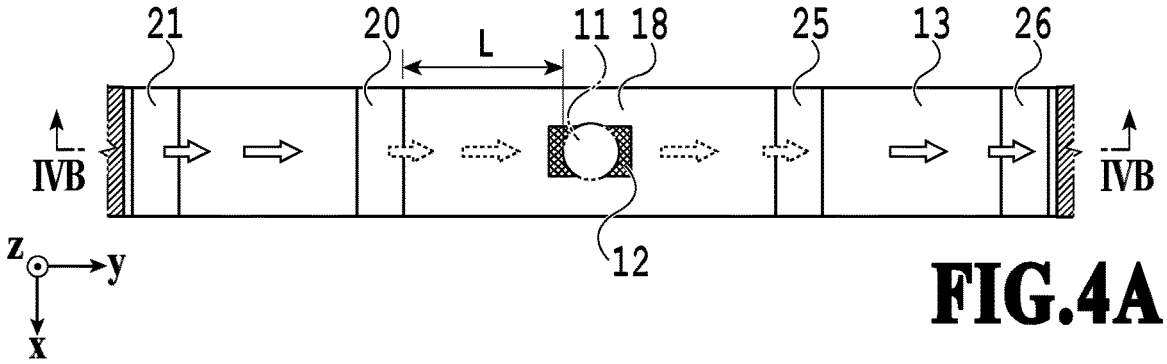
FIGS. 4A to 4D are diagrams for specifically explaining a configuration of a liquid channel and a pressure chamber in a first embodiment.
Figure 4B:
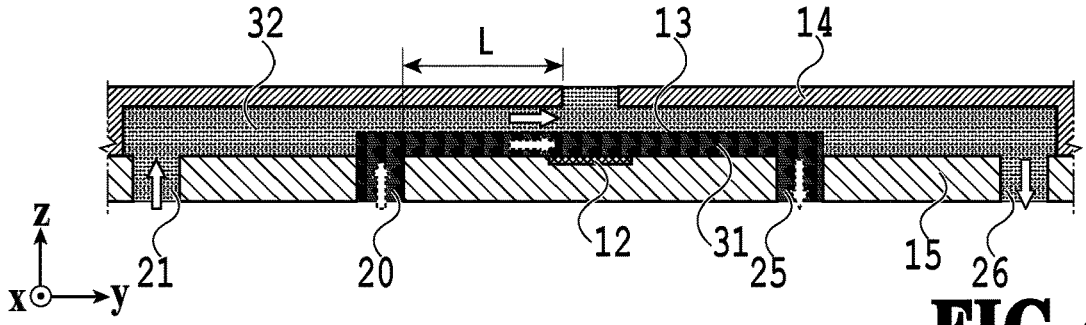
Figure 4C:
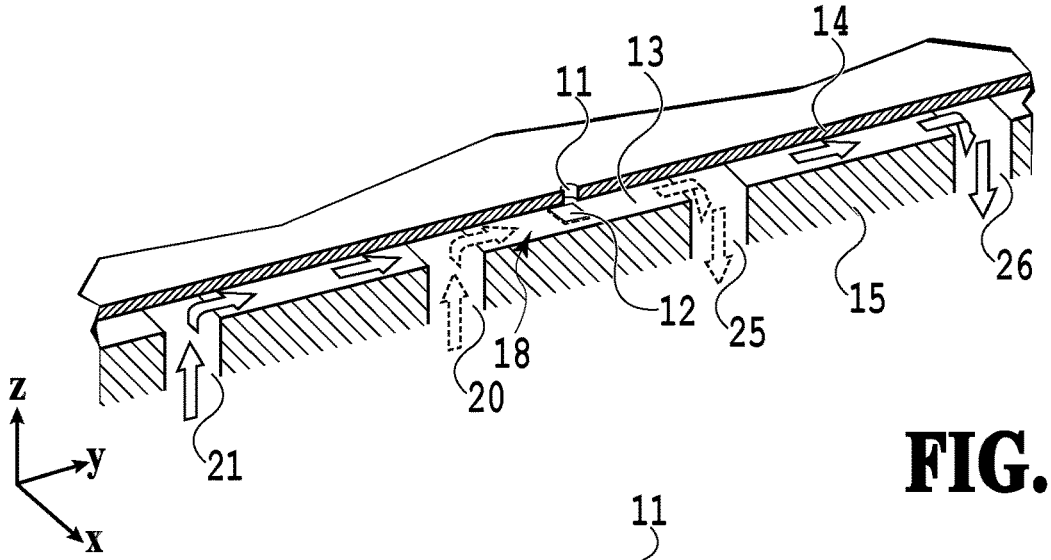
Figure 4D:
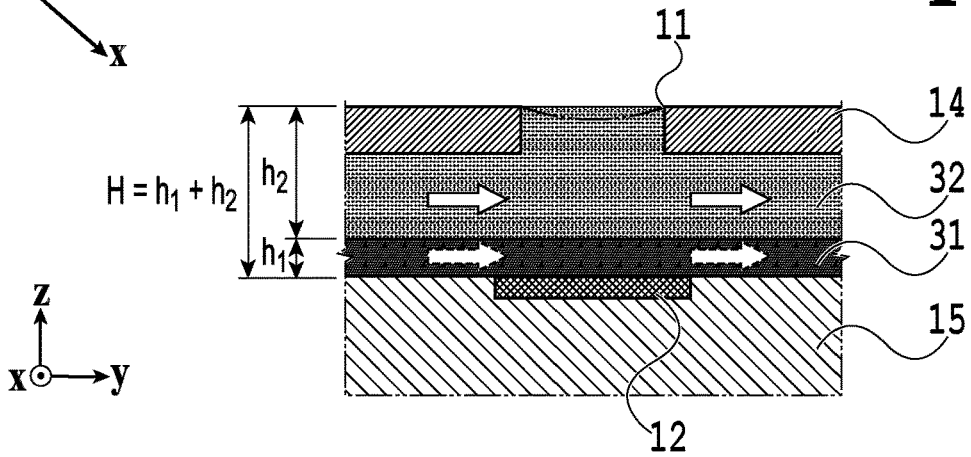

FIGS. 4A to 4D are diagrams for specifically explaining a configuration of one liquid channel 13 and one pressure chamber 18 formed in an element substrate 10. FIG. 4A is a transparent view from the ejection orifices 11 side (+z direction side), and FIG. 4B is a cross-sectional view taken along the IVB-IVB section line shown in FIG. 4A. Also, FIG. 4C is an enlarged view of one liquid channel 13 and its surroundings in the element substrate 10 shown in FIG. 3. Further, FIG. 4D is an enlarged view of the ejection orifice and its surroundings in FIG. 4B.

In a portion of the silicon substrate 15 corresponding to the bottom of the liquid channel 13, a second inlet port 21, a first inlet port 20, a first outlet port 25, and a second outlet port 26 are formed in this order in the y direction. Moreover, the pressure chamber 18 communicating with the ejection orifice 11 and containing the pressure generation element 12 is disposed in the liquid channel 13 substantially at the midpoint between the first inlet port 20 and the first outlet port 25. In FIGS. 4A and 4B, an interface formation distance L is the distance between the first inlet port 20 and the ejection orifice 11 in the y direction. The second inlet port 21 is connected to the second common supply channel 28, the first inlet port 20 is connected to the first common supply channel 23, the first outlet port 25 is connected to the first common collection channel 24, and the second outlet port 26 is connected to the second common collection channel 29 (see FIG. 3).

In the above configuration, a first liquid 31 supplied from the first common supply channel 23 into the liquid channel 13 through the first inlet port 20 flows in the y direction (the direction indicated by the broken-line arrows), passes the pressure chamber 18, and is then collected into the first common collection channel 24 through the first outlet port 25. On the other hand, a second liquid 32 supplied from the second common supply channel 28 into the liquid channel 13 through the second inlet port 21 flows in the y direction (the direction indicated by the white arrows), passes the pressure chamber 18, and is then collected into the second common collection channel 29 through the second outlet port 26. In other words, inside the liquid channel 13, both the first liquid 31 and the second liquid 32 flow together in the y direction between the first inlet port 20 and the first outlet port 25. In the present embodiment, the distance from the first inlet port 20 to the ejection orifice 11 in the region where both the first liquid 31 and the second liquid 32 flow together in the y direction is represented as the interface formation distance L.

Inside the pressure chamber 18, the pressure generation element 12 is in contact with the first liquid 31, and the second liquid 32 around the ejection orifice 11 exposed to the atmosphere forms a meniscus. Inside the pressure chamber 18, the first liquid 31 and the second liquid 32 flow such that the pressure generation element 12, the first liquid 31, the second liquid 32, and the ejection orifice 11 are arranged in this order. In other words, assuming that the pressure generation element 12 side is the lower side and the ejection orifice 11 side is the upper side, the second liquid 32 flows over the first liquid 31. Further, the first liquid 31 and the second liquid 32 are pressurized by the pressure generation element 12 below them to thereby be ejected from the lower side toward the upper side. Meanwhile, this up-down direction is the height direction of the pressure chamber 18 and the liquid channel 13.

In the present embodiment, the flow rate of the first liquid 31 and the flow rate of the second liquid 32 are adjusted according to physical properties of the first liquid 31 and physical properties of the second liquid 32 such that the first liquid 31 and the second liquid 32 flow as parallel flows moving alongside and in contact with each other inside the pressure chamber as shown in FIG. 4D.

(Condition for Formation of Parallel Laminar Flows)

First, a condition for formation of liquids into laminar flows inside a tube will be described. The Reynolds number Re, which indicates the ratio of viscosity and interfacial tension, has been known as a general index for flow evaluation.

Here, let a liquid's density, flow speed, characteristic length, and viscosity be p, u, d, and respectively. Then, the Reynolds number Re can be expressed by (formula 1).

$$Re=\rho ud/\eta \quad \text{(formula 1)}$$

Here, it is known that the smaller the Reynolds number Re is, the easier a laminar flow is formed. Specifically, it is known that a flow inside a circular tube is laminar in a case where the Reynolds number Re is, e.g., as small as about 2200, and the flow inside the circular tube is turbulent in a case where the Reynolds number Re is larger than about 2200.

In the case where the flow is laminar, it means the flow line is parallel to and does not cross the direction of advance of the flow. Then, in a case where two contacting liquids are both laminar, it is possible to form parallel flows with a stably formed interface between the two liquids.

Here, in the case of a general inkjet print head, a channel height (the height of the pressure chamber) H [μm] of each liquid channel (pressure chamber) around the ejection orifice is about 10 to 100 μm. Then, in a case where water (density $\rho=1.0\times103$ kg/m$^3$, viscosity $\eta=1.0$ cP) is caused to flow through the liquid channel of the inkjet print head at a flow speed of 100 mm/s, the Reynolds number is $Re=\rho ud/\eta\approx0.1$ to $1.0<<2200$. Hence, a laminar flow can be assumed to be formed.

Note that the liquid channel 13 and the pressure chamber 18 in the present embodiment may have a rectangular cross section, as illustrated in FIGS. 4A to 4D. Even in this case, since the height and width of the liquid channel 13 and the pressure chamber 18 in the liquid ejection head are sufficiently small, the liquid channel 13 and the pressure chamber 18 can be considered equivalent to a circular tube, that is, the height of the liquid channel 13 and the pressure chamber 18 can be considered as the diameter of a circular tube.

(Logical Conditions for Formation of Parallel Laminar Flows)

Next, conditions for formation of parallel flows of the two kinds of liquids with a stable interface therebetween inside the liquid channel 13 and the pressure chamber 18 will be described with reference to FIG. 4D. First, let the distance from the silicon substrate 15 to the ejection orifice surface of the orifice plate 14 be H [μm], and let the distance from the ejection orifice surface to the interface between the first liquid 31 and the second liquid 32 (the layer thickness of the second liquid) be $h_2$ [μm]. Also, let the distance from the interface to the silicon substrate 15 (the layer thickness of the first liquid) be $h_1$ [μm]. In other words, $H=h_1+h_2$.

Here, a boundary condition inside the liquid channel 13 and the pressure chamber 18 is assumed under which the speeds of the liquids at the wall surface of the liquid channel 13 and the pressure chamber 18 are zero. It is also assumed that the speed and shear stress of the interface between the first liquid 31 and the second liquid 32 are continuous. If, under these assumptions, the first liquid 31 and the second liquid 32 form two layers of constant parallel flows, the quadratic equation described in (formula 2) holds inside the parallel flow zone.

[Math. 1]

$$(\eta_1-\eta_2)(\eta_1Q_1+\eta_2Q_2)h_1^4+2\eta_1H\{\eta_2(3Q_1+Q_2)-2\eta_1Q_1\}h_1^3+3\eta_1H^2\{2\eta_1Q_1-\eta_2(3Q_1+Q_2)\}h_1^2+4\eta_1Q_1H^3(\eta_2-\eta_1)h_1+\eta_1^2Q_1H^4=0 \quad \text{(formula 2)}$$

Note that in (formula 2), $\eta_1$ denotes the viscosity of the first liquid, $\eta_2$ denotes the viscosity of the second liquid, $Q_1$ denotes the flow rate of the first liquid, and $Q_2$ denotes the flow rate of the second liquid. Specifically, the first liquid and the second liquid flow to form a positional relationship corresponding to their respective flow rates and viscosities within the range in which the above quadratic equation (formula 2) is satisfied. As a result, parallel flows with a stable interface are formed. In the present embodiment, it is preferable that these parallel flows of the first liquid and the second liquid be formed at least in the pressure chamber 18 in the liquid channel 13. In a case where such parallel flows are formed, the first liquid and the second liquid are mixed only at the interface by molecular diffusion, and flow in parallel to each other in the y direction without being substantially mixed with each other.

For example, even in a case of using immiscible solvents such as water and oil as the first liquid and the second liquid, stable parallel flows will be formed regardless of whether the liquids are immiscible as long as (formula 2) is satisfied. Also, in the case of water and oil too, it is preferable at least that the first liquid mainly flows over the pressure generation element and the second liquid mainly flows in the ejection orifice, as mentioned earlier, even if the flows inside the pressure chamber are somewhat disturbed and thus the interface is disturbed.

Figure 5A:
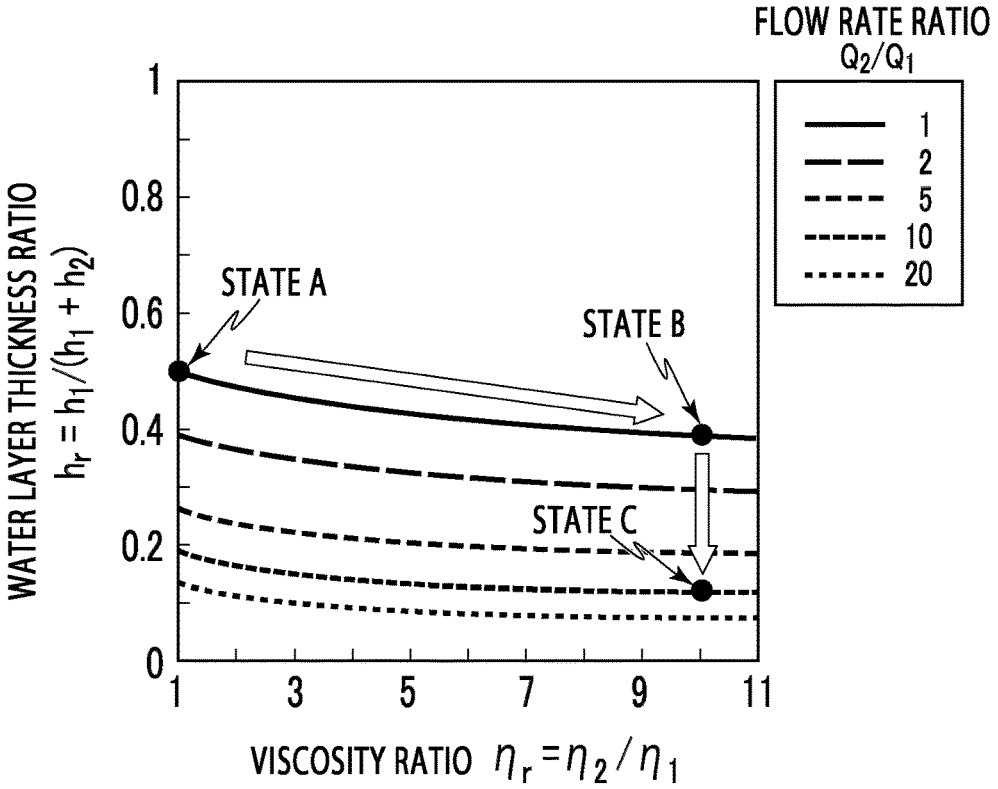
FIGS. 5A and 5B are diagrams showing the relationship between a viscosity ratio and a water layer thickness ratio, and the relationship between the height in the pressure chamber and the flow speed.

FIG. 5A is a diagram showing the relationship between a viscosity ratio $\eta_r=\eta_2/\eta_1$ and the first liquid's layer thickness ratio $h_r=h_1/(h_1+h_2)$ with a flow rate ratio $Q_r=Q_2/Q_1$ varied stepwise based on (formula 2). Note that although the first liquid is not limited to water, "the layer thickness ratio of the first liquid" will be hereinafter referred to as "water layer thickness ratio". The horizontal axis represents the viscosity ratio $\eta_r=\eta_2/\eta_1$ whereas the vertical axis represents the water layer thickness ratio $h_r=h_1/(h_1+h_2)$. The larger the flow rate ratio $Q_r$, the smaller the water layer thickness ratio $h_r$. Also, for each flow rate ratio $Q_r$, the larger the viscosity ratio $\eta_r$, the smaller the water layer thickness ratio $h_r$. Specifically, the water layer thickness ratio $h_r$ (the position of the interface between the first liquid and the second liquid) in the liquid channel 13 (pressure chamber) can be adjusted to a predetermined value by controlling the viscosity ratio $\eta_r$ and the flow rate ratio $Q_r$ of the first liquid and the second liquid. Then, according to the diagram, a comparison between the viscosity ratio $\eta_r$ and the flow rate ratio $Q_r$ indicates that the flow rate ratio $Q_r$ affects the water layer thickness ratio $h_r$ to a greater extent than the viscosity ratio $\eta_r$ does.

Here, a state A, a state B, and a state C shown in FIG. 5A represent the following states.

State A) The water layer thickness ratio $h_r=0.50$ with the viscosity ratio $\eta_r=1$ and the flow rate ratio $Q_r=1$.

State B) The water layer thickness ratio $h_r=0.39$ with the viscosity ratio $\eta_r=10$ and the flow rate ratio $Q_r=1$.

State C) The water layer thickness ratio $h_r=0.12$ with the viscosity ratio $\eta_r=10$ and the flow rate ratio $Q_r=10$.

Figure 5B:
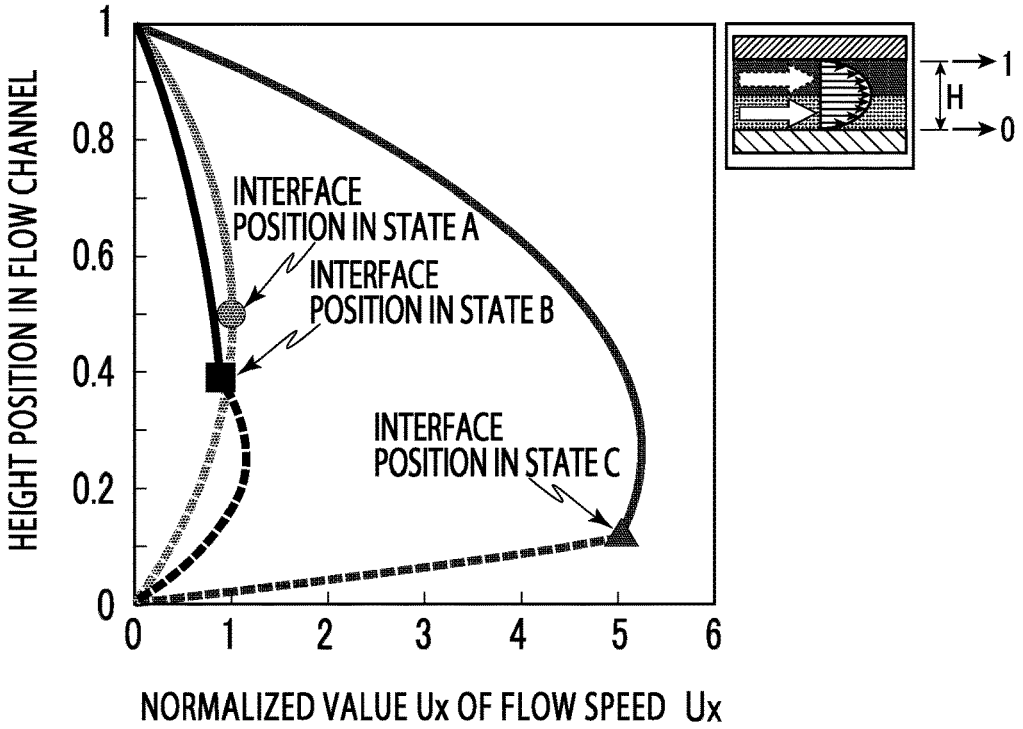

FIG. 5B is a diagram showing the distribution of flow speed in the liquid channel 13 (pressure chamber) in its height direction (z direction) for each of the above states A, B, and C. The horizontal axis represents a normalized value Ux normalized with the maximum value of the flow speed in the state A being 1 (reference). The vertical axis represents the height from the bottom surface with the height H of the liquid channel 13 (pressure chamber) being 1 (reference). On each of the curves indicating the above states, the position of the interface between the first liquid and the second liquid is indicated by a marker. It can be seen that the interface position varies from one state to another, like the interface position in the state A is higher than the interface positions in the state B and the state C. This is because, in a case where two kinds of liquids having different viscosities flow in parallel to each other as laminar flows (as a laminar flow as a whole) inside a tube, the interface between these two liquids is formed at the position at which the pressure difference originating from the viscosity difference between these liquids and the Laplace pressure originating from the interfacial tension balance each other.

(State of Transition in Ejection Operation)

Next, a description will be given of a state of transition in an ejection operation inside the liquid channel 13 and the pressure chamber 18 in which parallel flows are formed. FIGS. 6A to 6E are diagrams schematically showing a state of transition in an ejection operation performed in a state where parallel flows are formed with a first liquid and a second liquid having a viscosity ratio of $\eta_r=4$ inside a liquid channel 13 with a channel (pressure chamber) height of H [μm]=20 μm and an orifice plate thickness of T=6 μm.

Figures 6A, 6B, 6C, 6D, 6E:
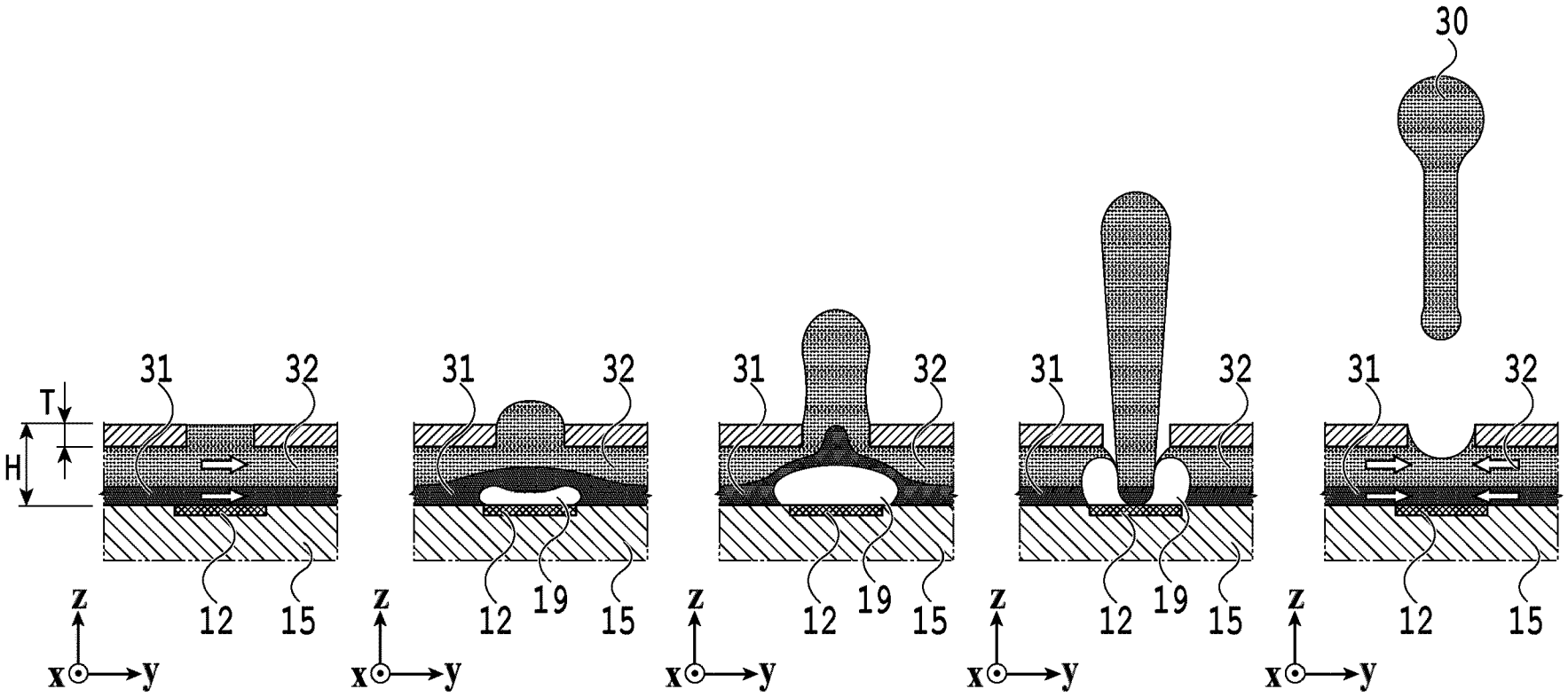
FIGS. 6A to 6E are diagrams schematically showing a state of transition in an ejection operation.

FIG. 6A shows a state before a voltage is applied to the pressure generation element 12. This diagram shows a state where $Q_1$ and $Q_2$ of the first and second liquids, which flow together, are adjusted such that the interface position is stable at the positon position at which the water layer thickness ratio $\eta_r=0.57$ (i.e., the first liquid's water thickness $h_1$ [μm]=6 μm).

FIG. 6B shows a state where the voltage starts to be applied to the pressure generation element 12. The pressure generation element 12 in the present embodiment is an electrothermal converter (heater). Specifically, in a case where a voltage pulse corresponding to an ejection signal is applied, the pressure generation element 12 abruptly generates heat, thereby causing film boiling inside the first liquid contacting the pressure generation element 12. The diagram shows a state where a bubble 19 is generated by the film boiling. By the generation of the bubble 19, the interface between the first liquid 31 and the second liquid 32 is moved accordingly in the z direction (the height direction of the pressure chamber), so that the second liquid 32 is pushed out from the ejection orifice 11 in the z direction.

FIG. 6C shows a state where the volume of the bubble 19 generated by the film boiling has increased, thereby pushing the second liquid 32 further out from the ejection orifice 11 in the z direction.

FIG. 6D shows a state where the bubble 19 is communicating with the atmosphere. In the present embodiment, at a contraction stage after the bubble 19 has fully grown, the bubble 19 and the gas-liquid interface having moved from the ejection orifice 11 to the pressure generation element 12 side communicate with each other.

FIG. 6E shows a state where a droplet 30 has been ejected. The liquid which had already projected from the ejection orifice 11 at the time when the bubble 19 communicated with the atmosphere as shown in FIG. 6D now exits the liquid channel 13 with its own inertia and flies in the form of the droplet 30 in the z direction. In the liquid channel 13, on the other hand, the amount of the liquid consumed by the ejection is supplied from both sides of the ejection orifice 11 by capillary force in the liquid channel 13, so that a meniscus is formed in the ejection orifice 11 again. Thereafter, parallel flows of the first liquid and the second liquid flowing in the y direction as illustrated in FIG. 6A are formed again.

As described above, in the present embodiment, the ejection operation shown in FIGS. 6A to 6E is performed with the first liquid 31 and the second liquid 32 flowing as parallel flows. To specifically describe this with reference to FIG. 2 again, the CPU 500 uses the liquid circulation unit 504 to circulate the first liquid and the second liquid inside the ejection head 1 while maintaining the flow rate of the first liquid and the flow rate of the second liquid constant. Then, while continuing such control, the CPU 500 applies a voltage to each individual pressure generation element 12 disposed in the ejection head 1 in accordance with ejection data.

Note that performing an ejection operation with the liquids flowing entails a concern that the flow of the liquids may affect the ejection performance. However, the droplet ejection speed of a general inkjet print head is on the order of several m/s to several tens m/s and is significantly greater than the speed of the flow inside the liquid channel, which is on the order of several mm/s to several m/s. Thus, even in the case where an ejection operation is performed with the first liquid and the second liquid flowing at several mm/s to several m/s, it is unlikely to affect the ejection performance.

Although FIGS. 6A to 6E illustrate a configuration in which the bubble 19 communicates with the atmosphere inside the pressure chamber 18, the configuration may be such that, for example, the bubble 19 communicates with the atmosphere outside the ejection orifice 11 (atmosphere side) or disappears without communicating with the atmosphere.

An ejection operation as explained in FIGS. 6A to 6E can be performed with the liquids caused to flow or with the liquids temporarily stopped. Performing an ejection operation with the liquids flowing, for example, entails a concern that the flow of the liquids may affect the ejection performance. However, the droplet ejection speed of a general inkjet print head is on the order of several m/s to several tens m/s and is significantly greater than the speed of the flow inside the liquid channel (pressure chamber), which is on the order of several mm/s to several m/s. Thus, even in the case where an ejection operation is performed with the first liquid 31 and the second liquid 32 flowing at several mm/s to several m/s, it is unlikely to affect the ejection performance.

On the other hand, performing an ejection operation with the liquids stopped entails a concern that the ejection operation may change the position of the interface between the first liquid 31 and the second liquid 32. However, stopping the flow of the liquids does not immediately affect the diffusion at the interface between the first liquid 31 and the second liquid 32. Even in the case where the flow is stopped, the interface between the first liquid 31 and the second liquid 32 is maintained and the ejection operation can be performed in this state as long as the time of the stop is as short as the time taken to perform an ejection operation.

In either case, the ejection operation can be stably performed regardless of whether the first liquid 31 and the second liquid 32 are flowing or not, as long as the interface between the liquids is held at a stable position.

(Relationship Between Interface Formation Distance and Ejection Orifice Position)

Next, a description will be given of the length (distance) of the interface and the position of the interface relative to the ejection orifice for performing a normal ejection operation at the ejection orifice 11. The first liquid 31 and the second liquid 32 do not always form a straight and stable interface from the position at which they contact each other. A certain movement distance may be required from the point when the first liquid 31 and the second liquid 32 contact each other before a stable interface is obtained. In the description, the movement distance required from the position at which the first liquid 31 and the second liquid 32 contact each other before a stable interface is obtained will be hereinafter referred to as an interface stabilization distance Le.

The interface stabilization distance Le can be considered basically as the entrance length required for a flow having entered a tubular path to become developed and stable. For parallel flows, the interface stabilization distance Le can be figured out from formula 3 below, for example.

[Math. 2]

$$Le=De(0.0550Re+0.379\exp(-0.148Re)+0.260) \quad \text{(formula 3)}$$

Here, Re denotes the Reynolds number, and De denotes an equivalent diameter. The equivalent diameter De is calculated from formula 4 with a channel cross-sectional area Af and a wetted perimeter Wp.

$$De=4Af/Wp \quad \text{(formula 4)}$$

In other words, the interface stabilization distance Le can be figured out from formula 5.

[Math. 3]

$$Le=4Af(0.0550Re+0.379\exp(-0.148Re)+0.260)/Wp \quad \text{(formula 5)}$$

Also, in the description, the distance from the position at which the first liquid 31 and the second liquid 32 contact each other to the ejection orifice 11 will be referred to as the interface formation distance L. In the present embodiment illustrated in FIGS. 4A to 4D, the interface formation distance L is the distance from the first inlet port 20 to the ejection orifice 11. The interface formation distance L and the interface stabilization distance Le are required to satisfy a relationship of L>Le in order for the first liquid 31 and the second liquid 32 to form a stable interface at the position of the ejection orifice 11.

Figure 7A:
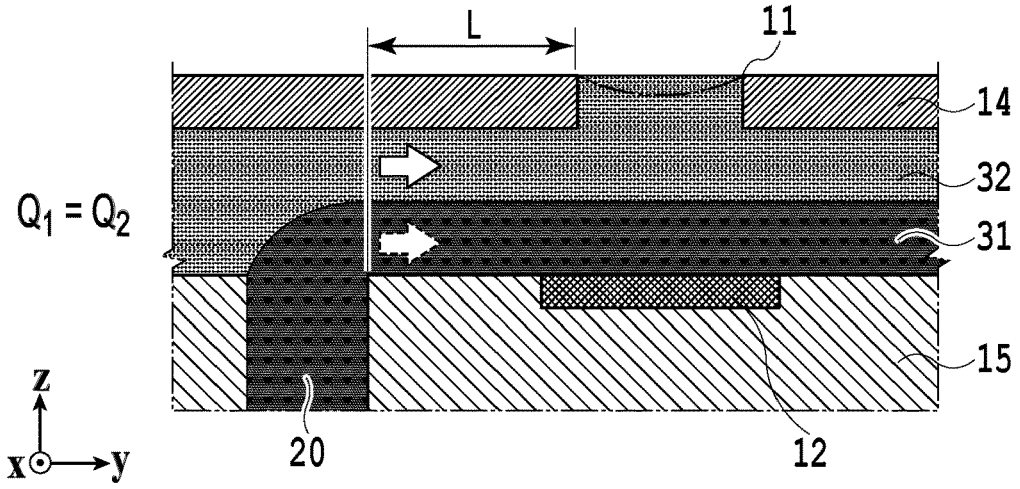
FIGS. 7A to 7C are diagrams specifically explaining formed states of an interface in the first embodiment.
Figure 7B:
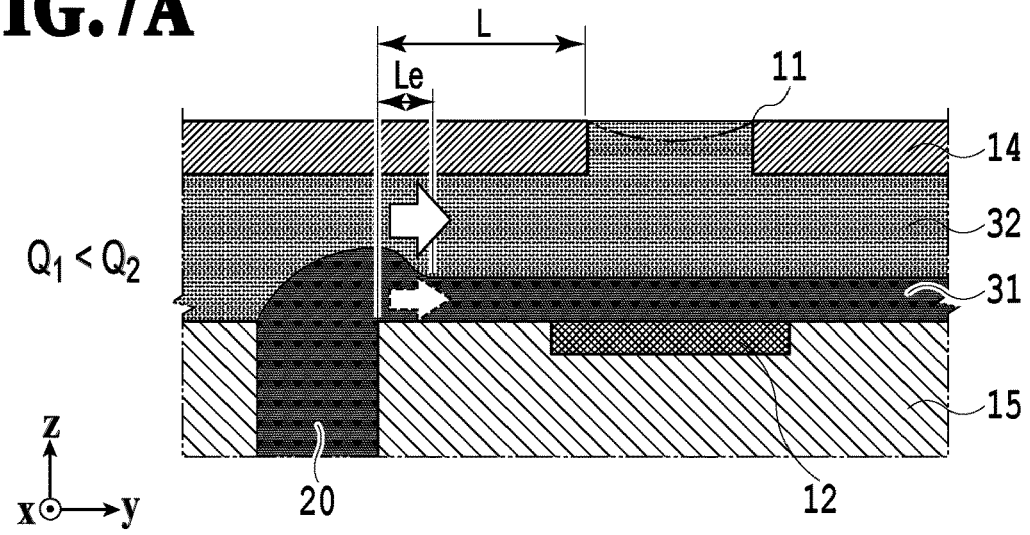
Figure 7C:
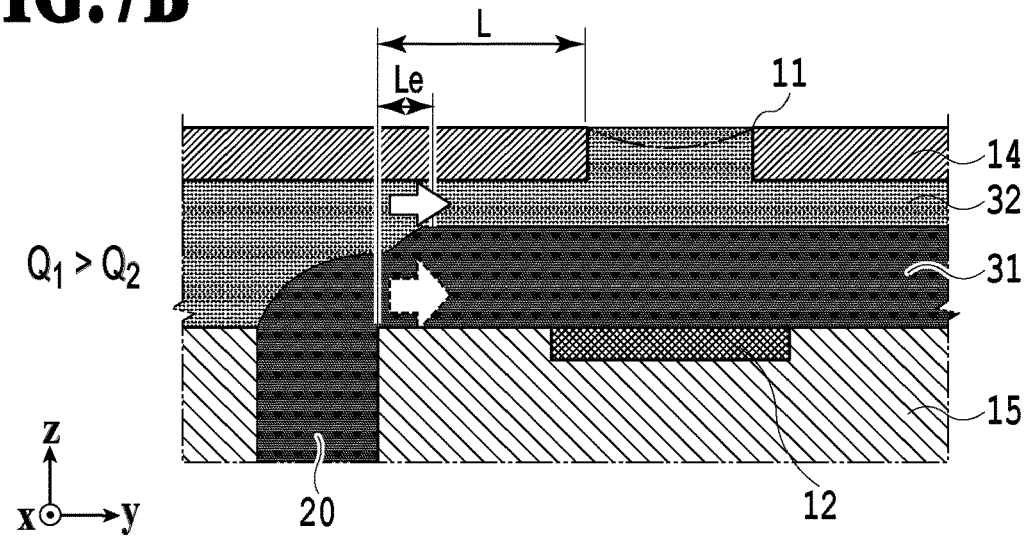

FIGS. 7A to 7C are diagrams specifically explaining formed states of the interface in the present embodiment. These diagrams show cases with different magnitude relationships between the flow rate $Q_1$ of the first liquid 31 and the flow rate $Q_2$ of the second liquid 32 under the condition that the viscosity $\eta_1$ of the first liquid 31 and the viscosity $\eta_2$ of the second liquid 32 are equal ($\eta_r=1$).

FIG. 7A shows a case where the flow rate $Q_1$ of the first liquid 31 and the flow rate $Q_2$ of the second liquid 32 are equal ($Q_1=Q_2$). Since the viscosity ratio $\eta_r=1$, the water layer thickness ratio is $h_r=0.5$. The interface between the first liquid 31 and the second liquid 32 has a water layer thickness ratio of $h_r=0.5$ from substantially the same position as the position where the first liquid 31 flows in from the first inlet port 20, and the interface between the first liquid 31 and the second liquid 32 is stable at the water layer thickness ratio $h_r=0.5$.

FIG. 7B shows a case where the flow rate $Q_1$ of the first liquid 31 is lower than the flow rate $Q_2$ of the second liquid 32 ($Q_1<Q_2$). In this case, the water layer thickness ratio is $h_r<0.5$. The interface between the first liquid 31 and the second liquid 32 becomes stable at the water layer thickness ratio $h_r<0.5$ after the first liquid 31 flows in from the first inlet port 20 and moves the interface stabilization distance Le in the y direction.

FIG. 7C shows a case where the flow rate $Q_1$ of the first liquid 31 is higher than the flow rate $Q_2$ of the second liquid 32 ($Q_1>Q_2$). In this case, the water layer thickness ratio is $h_r>0.5$. The interface between the first liquid 31 and the second liquid 32 becomes stable at the water layer thickness ratio of $h_r>0.5$ after the first liquid 31 flows in from the first inlet port 20 and moves the interface stabilization distance Le in the y direction.

In any of the cases, in the present embodiment, the relative positions of the ejection orifice 11 and the first inlet port 20 are determined so as to obtain an interface formation distance L greater than the interface stabilization distance Le required to stabilize the interface between the first liquid 31 and the second liquid 32.

In sum, according to the present embodiment, the first inlet port 20, from which the first liquid 31 flows in, is provided at a position upstream of the ejection orifice 11 in the flow direction of the first liquid 31 and the second liquid 32 (y direction). This makes it possible to stabilize the interface between the first liquid 31 and the second liquid 32 at a position upstream of the ejection orifice 11 and maintain a fine ejection operation at the ejection orifice 11.

Second Embodiment

Figure 8A:
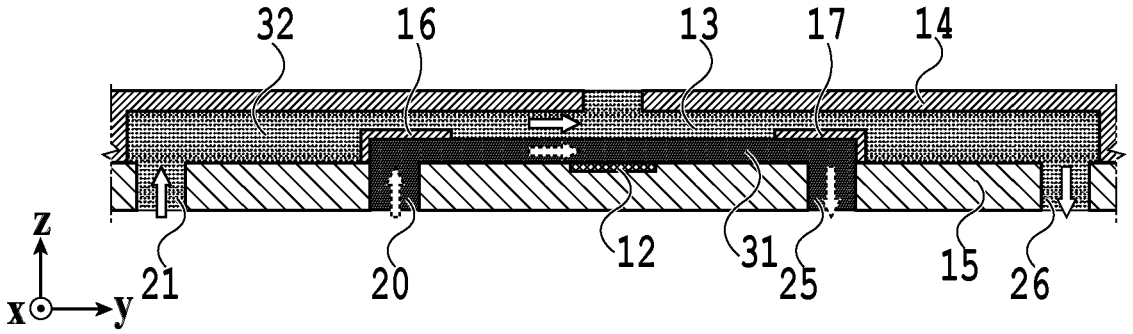
FIGS. 8A and 8B are diagrams for specifically explaining a configuration of a liquid channel and a pressure chamber in a second embodiment.
Figure 8B:
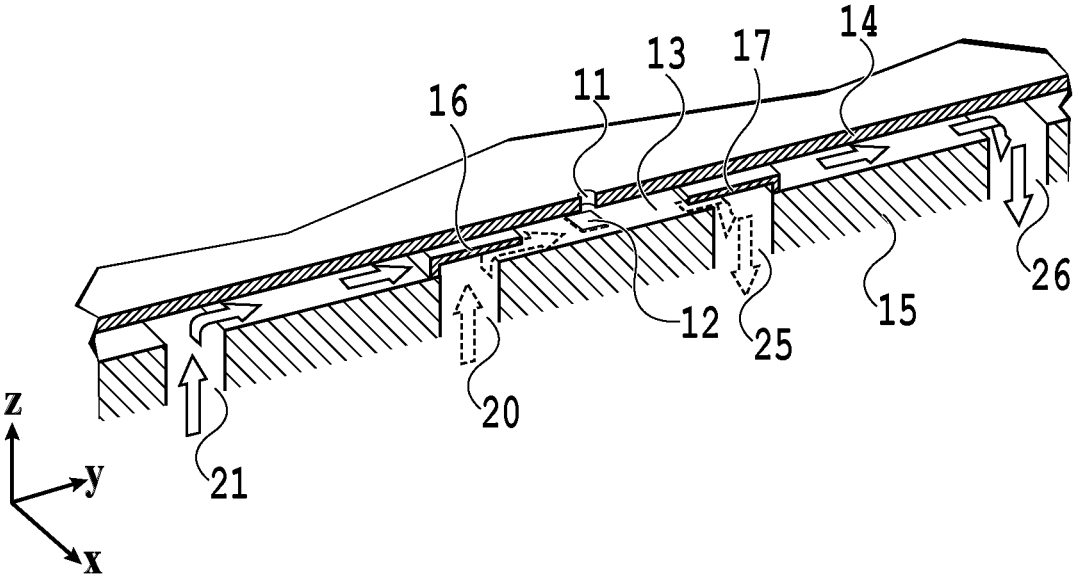

FIGS. 8A and 8B are diagrams showing the liquid channel 13 in a second embodiment. The liquid channel 13 in the present embodiment is provided with an L-shaped merge wall 16 and separation wall 17 that cause the first liquid 31 and the second liquid 32 to move in parallel to each other in a separated state in the y direction. The merge wall 16 is a wall provided at a portion where the first liquid 31 and the second liquid 32 merge. The separation wall 17 is a wall that separates the first liquid 31 and the second liquid 32 from each other. Specifically, the first liquid 31 and the second liquid 32 are merged and separated in a parallel state, instead of being merged and separated at an angle with respect to each other as in the first embodiment. Accordingly, the turbulence in the flow caused by the merge and separation is kept low.

The first liquid 31 and the second liquid 32 contact and merge with each other at the downstream end of the merge wall 16 to thereby form parallel flows. In the present embodiment, a height He of the merge wall 16 is a half of that of the liquid channel 13, or $He=(h_1+h_2)/2$. The first liquid 31 and the second liquid 32 after passing the ejection orifice 11 are vertically separated by the separation wall 17.

Figure 9A:
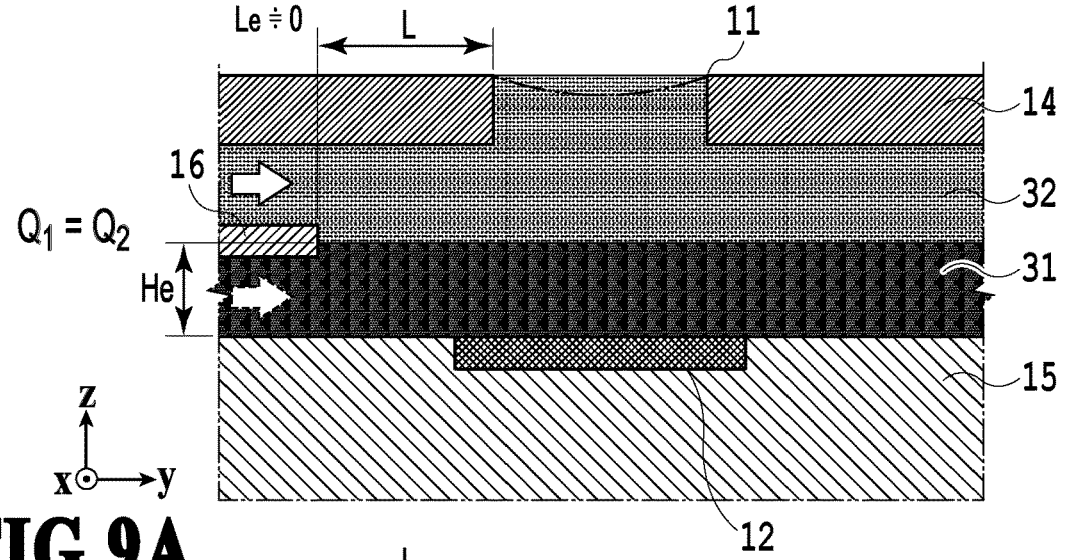
FIGS. 9A to 9C are diagrams specifically explaining formed states of an interface in the second embodiment.
Figure 9B:
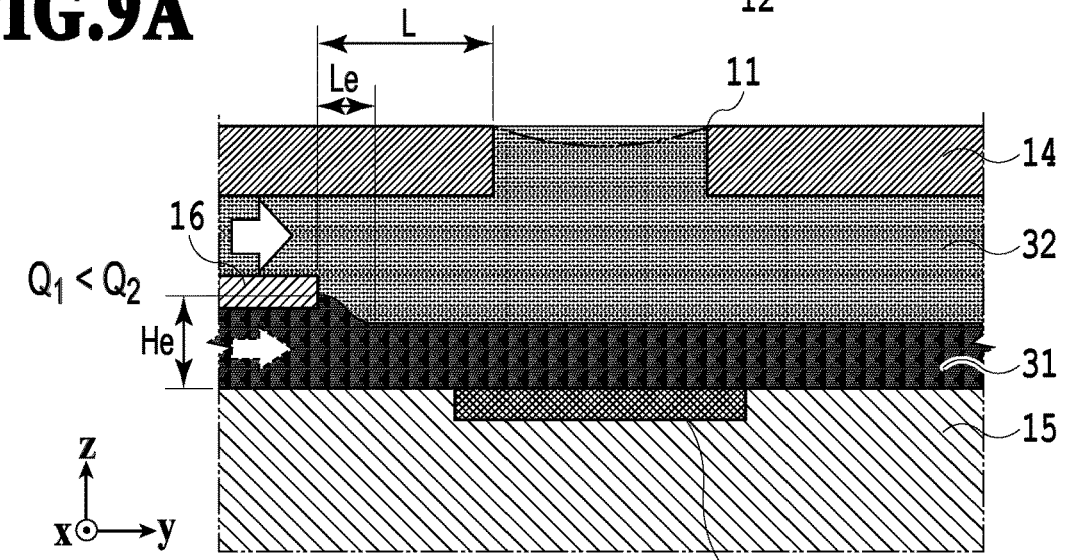
Figure 9C:
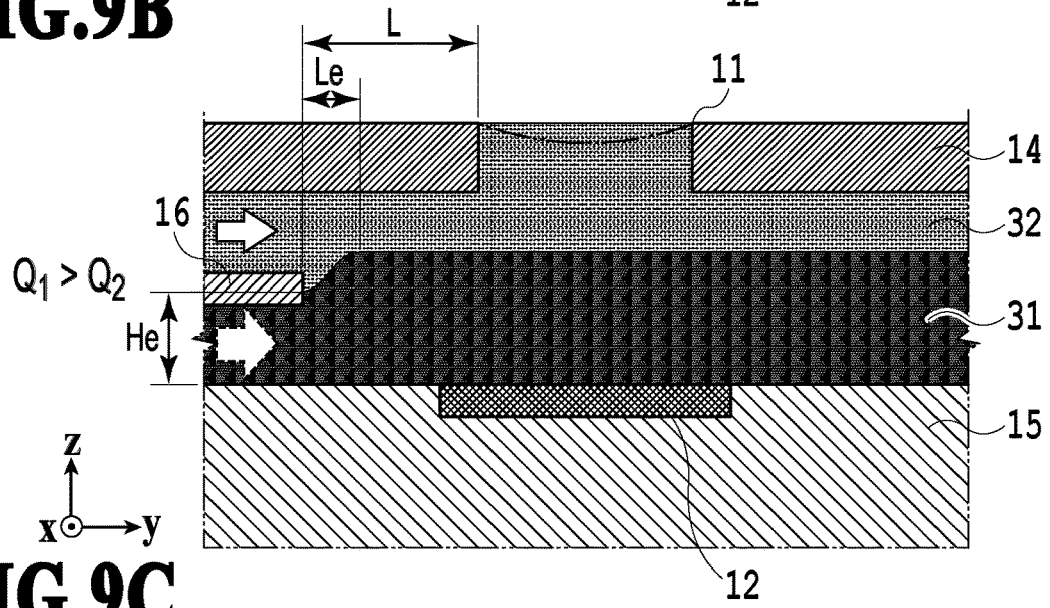

FIGS. 9A to 9C are diagrams specifically explaining formed states of the interface in the present embodiment. These diagrams show cases with different magnitude relationships between the flow rate $Q_1$ of the first liquid 31 and the flow rate $Q_2$ of the second liquid 32 under the condition that the viscosity $\eta_1$ of the first liquid 31 and the viscosity $\eta_2$ of the second liquid 32 are equal ($\eta_r=1$). Note that the separation wall 17 is omitted in the illustration of FIGS. 9A to 9C.

FIG. 9A shows a case where the flow rate $Q_1$ of the first liquid 31 and the flow rate $Q_2$ of the second liquid 32 are equal ($Q_1=Q_2$). Since the viscosity ratio $\eta_r=1$, the water layer thickness ratio is $h_r=0.5$. Specifically, the height of the interface between the first liquid 31 and the second liquid 32 is substantially equal to the height of the merge wall 16, and the interface between the first liquid 31 and the second liquid 32 is stable at the water layer thickness ratio $h_r=0.5$ from substantially the same position as the end of the merge wall 16.

FIG. 9B shows a case where the flow rate $Q_1$ of the first liquid 31 is lower than the flow rate $Q_2$ of the second liquid 32 ($Q_1<Q_2$). In this case, the water layer thickness ratio is $h_r<0.5$. Specifically, the interface between the first liquid 31 and the second liquid 32 becomes stable at a position lower than the merge wall 16 after moving the interface stabilization distance Le in the y direction.

FIG. 9C shows a case where the flow rate $Q_1$ of the first liquid 31 is higher than the flow rate $Q_2$ of the second liquid 32 ($Q_1>Q_2$). In this case, the water layer thickness ratio is $h_r>0.5$. Specifically, the interface between the first liquid 31 and the second liquid 32 becomes stable at a position higher than the merge wall 16 after moving the interface stabilization distance Le in the y direction.

In any of the cases, in the present embodiment, an interface formation distance L is provided which is greater than the interface stabilization distance Le required to stabilize the interface between the first liquid 31 and the second liquid 32.

Figure 10A:
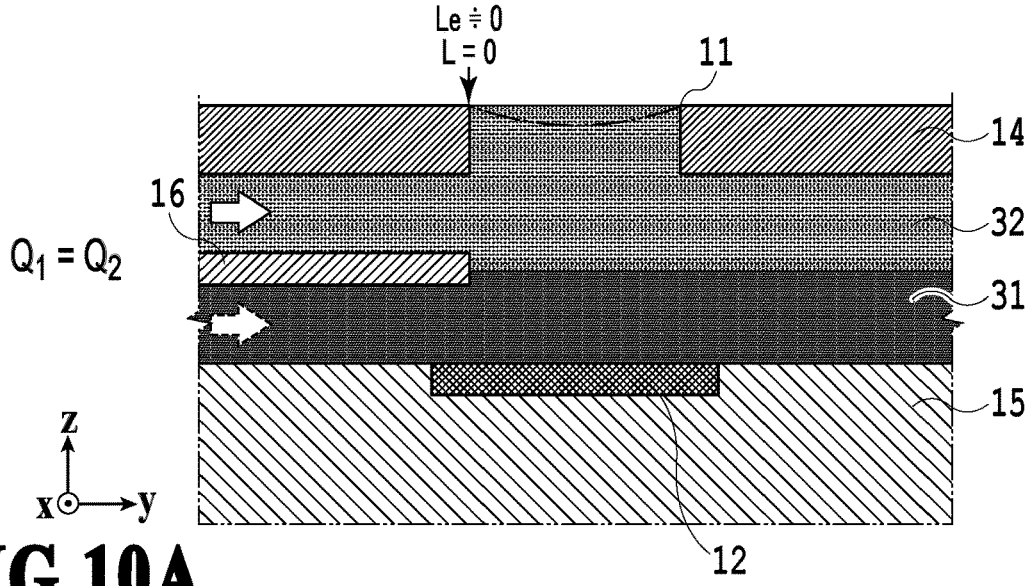
FIGS. 10A to 10C are diagrams to be compared with the formed states of the interface in the second embodiment.
Figure 10B:
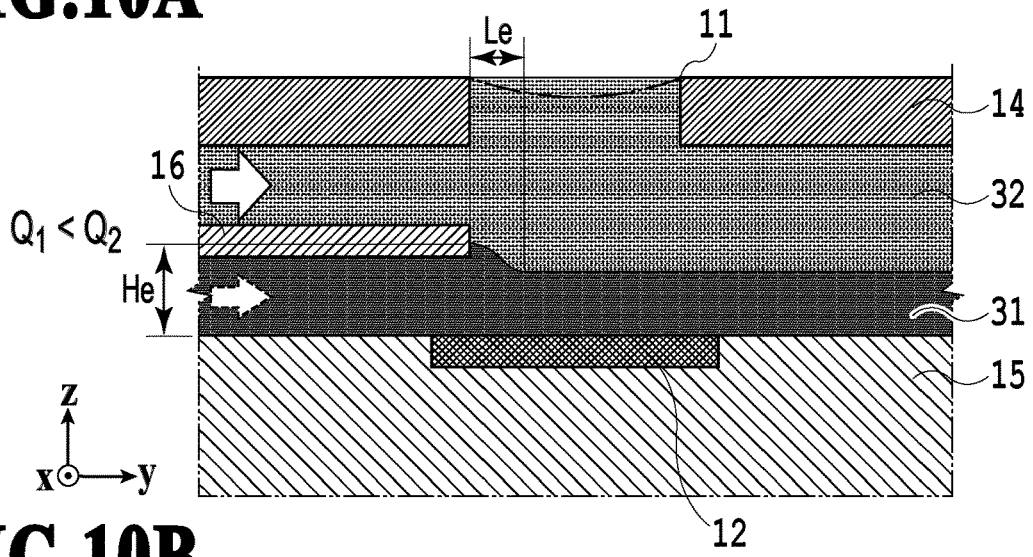
Figure 10C:
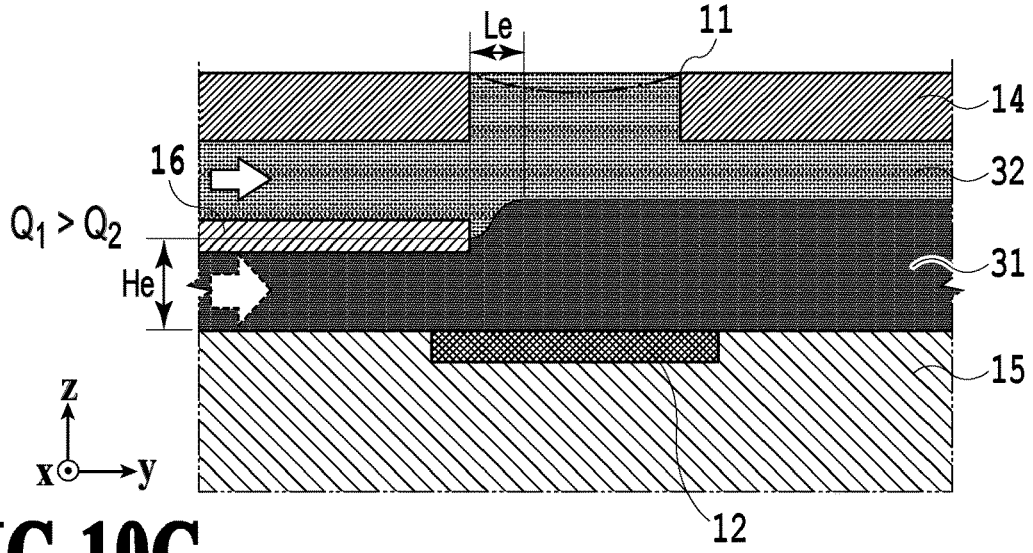

FIGS. 10A to 10C are diagrams to be compared with the formed states of the interface in the present embodiment shown in FIGS. 9A to 9C. FIGS. 10A to 10C differ from FIGS. 9A to 9C in that the merge wall 16 extends to the ejection orifice 11. Specifically, in these comparative examples, the interface formation distance is L=0.

FIG. 10A shows a case where the flow rate $Q_1$ of the first liquid 31 and the flow rate $Q_2$ of the second liquid 32 are equal ($Q_1=Q_2$). In this case, as in FIG. 9A, the height of the interface between the first liquid 31 and the second liquid 32 is substantially equal to that of the merge wall 16, and the interface between the first liquid 31 and the second liquid 32 is stable at a water layer thickness ratio of $h_r=0.5$ from substantially the same position as the end of the merge wall 16, i.e., directly under the ejection orifice 11.

FIGS. 10B and 10C, on the other hand, show cases where the flow rate $Q_1$ of the first liquid 31 and the flow rate $Q_2$ of the second liquid 32 are different ($Q_1<Q_2$ or $Q_1>Q_2$). In these cases, the interface between the first liquid 31 and the second liquid 32 becomes stable at a position where the water layer thickness ratio is not $h_r=0.5$, and that interface height is different from the height He of the merge wall 16. Specifically, a predetermined interface stabilization distance Le is required for the first liquid 31 and the second liquid 32 to form a stable interface after passing the end of the merge wall 16. Thus, in the cases of FIGS. 10B and 10C, L>Le is not satisfied, and there is a possibility that a normal ejection operation cannot be performed.

The flow rate $Q_1$ of the first liquid, the flow rate $Q_2$ of the second liquid, and their ratio are each controlled by the liquid circulation unit 504 (see FIG. 2) to be maintained at a constant value. However, even under such control, the above flow rates in each individual liquid channel 13 may be changed to no small extent by variation of the operation of the pumps in the liquid circulation unit 504 or the like. Specifically, even if the liquid circulation unit 504 performs control to obtain the state of FIG. 10A, each individual liquid channel 13 may fall into the state of FIG. 10B or the state of FIG. 10C and the ejection operation may be unstable.

However, by positioning the end of the merge wall 16 well upstream of the ejection orifice 11, the interface formation distance L is greater than the interface stabilization distance Le (L>Le), as shown in FIGS. 9A to 9C. Specifically, even in a case where there is some variation in the flow rates of the first liquid 31 and the second liquid 32 in each individual liquid channel 13, a stable interface is formed directly under the ejection orifice 11, thereby enabling a stable ejection operation to be performed.

Figure 11A:
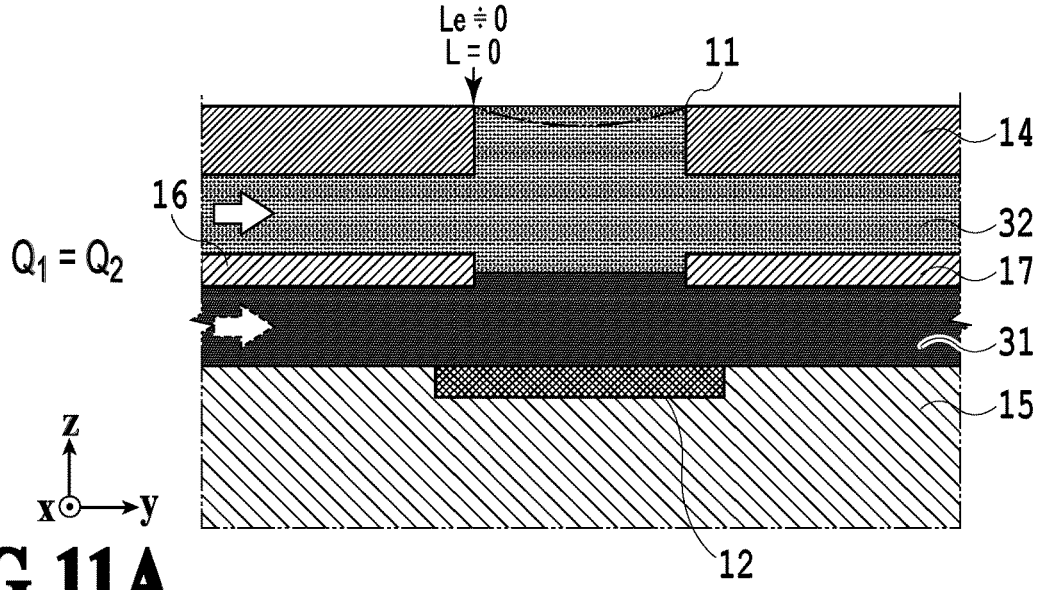
FIGS. 11A to 11C are diagrams to be compared with the formed states of the interface in the second embodiment.
Figure 11B:
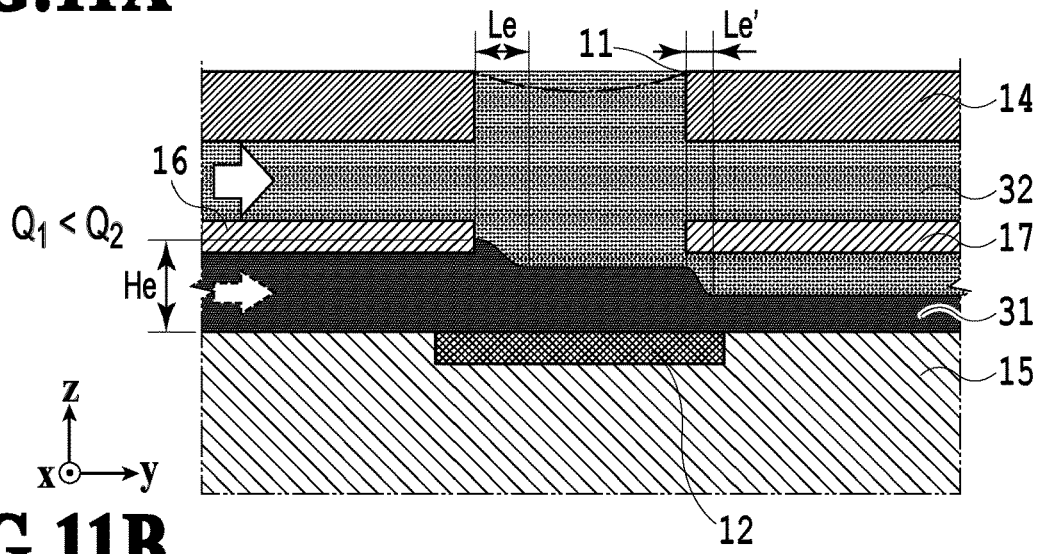
Figure 11C:
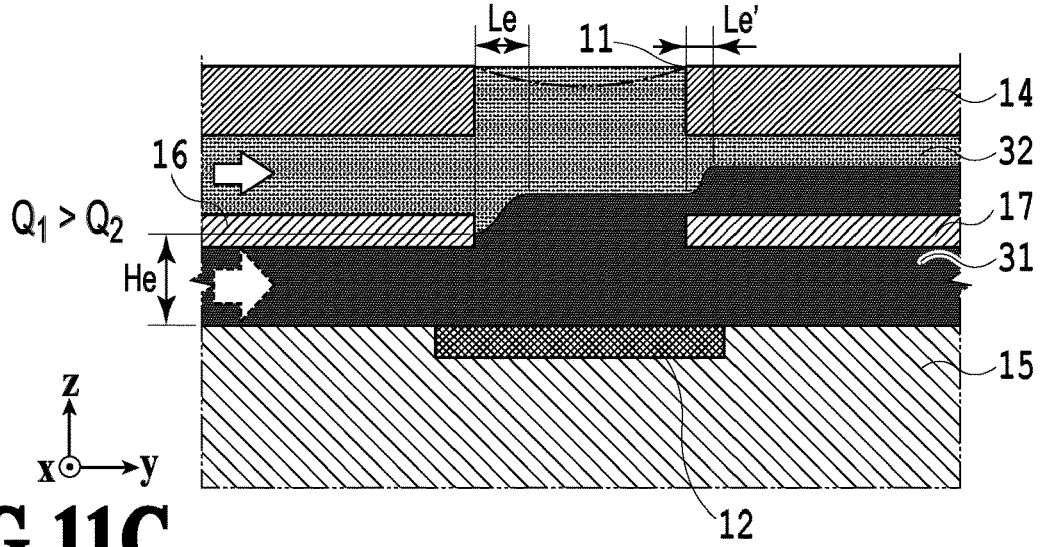

FIGS. 11A to 11C are diagrams obtained by additionally showing the separation wall 17 in FIGS. 10A to 10C. FIG. 11A shows a case where the flow rate $Q_1$ of the first liquid 31 and the flow rate $Q_2$ of the second liquid 32 are equal ($Q_1=Q_2$). In this case, as in FIG. 10A, the interface between the first liquid 31 and the second liquid 32 is stable at a water layer thickness ratio of $h_r=0.5$ from substantially the same position as the end of the merge wall 16, i.e., directly under the upstream side of the ejection orifice 11. Then, the first liquid 31 and the second liquid 32 get separated at the position of the front edge of the separation wall 17, i.e., directly under the downstream side of the ejection orifice 11, and the first liquid 31 flows into the lower channel while the second liquid 32 flows into the upper channel.

FIG. 11B shows a case where the flow rate $Q_1$ of the first liquid 31 is lower than the flow rate $Q_2$ of the second liquid 32 ($Q_1<Q_2$). In this case, the water layer thickness ratio is $h_r<0.5$. The interface between the first liquid 31 and the second liquid 32 becomes stable at a position lower than the merge wall 16 after moving a predetermined interface stabilization distance Le in the y direction from the end of the merge wall 16. Then, the first liquid 31 and the second liquid 32 get separated by the separation wall 17 such that only the second liquid 32 flows through the upper liquid channel whereas the first liquid 31 and the second liquid 32 are both present in the lower liquid channel. In the lower liquid channel, the interface becomes stable at the predetermined water layer thickness ratio $h_r<0.5$ after moving a predetermined interface stabilization distance Le' in the y direction again.

FIG. 11C shows a case where the flow rate $Q_1$ of the first liquid 31 is higher than the flow rate $Q_2$ of the second liquid 32 ($Q_1>Q_2$). In this case, the water layer thickness ratio is $h_r>0.5$. Specifically, the interface between the first liquid 31 and the second liquid 32 becomes stable at a position higher than the merge wall 16 after moving the predetermined interface stabilization distance Le in the y direction from the end of the merge wall 16. Then, the first liquid 31 and the second liquid 32 get separated by the separation wall 17 such that the second liquid 32 and the first liquid 31 are both present in and flow through the upper liquid channel whereas only the first liquid 31 flows through the lower liquid channel. In the upper liquid channel, the interface becomes stable at the predetermined water layer thickness ratio $h_r>0.5$ after moving the predetermined interface stabilization distance Le' in the y direction again.

In the present embodiment, the installation position of the separation wall 17 does not greatly affect the ejection state at the ejection orifice 11 as long as the separation wall 17 is provided outside the ejection orifice 11. This is because the interface stabilization distance Le' is present downstream of the separation wall 17. Specifically, in view of implementing a normal ejection operation, the separation wall 17 only needs to be provided downstream of the ejection orifice 11, and its distance from the ejection orifice is not limited unlike the merge wall 16. However, in a case where the interface between the first liquid 31 and the second liquid 32 is asymmetrical around the ejection orifice 11, there is a possibility that the proportion of the second liquid contained in the ejected droplet 30 may be unstable. Thus, in view of the above, it is preferable to dispose the separation wall 17 at a position separated as far as possible from the ejection orifice 11.

As described above, according to the present embodiment, the downstream end of the merge wall 16 for causing the first liquid 31 and the second liquid 32 to move in parallel to each other in a separated state is provided at a position upstream of the ejection orifice 11 in the flow direction of the first liquid 31 and the second liquid 32 (y direction). In this way, the interface between the first liquid 31 and the second liquid 32 becomes stable at a position upstream of the ejection orifice 11. This makes it possible to maintain a fine ejection operation at the ejection orifice 11.

Third Embodiment

A third embodiment also uses the ejection head 1 and the liquid ejection apparatus shown in FIGS. 1 to 3.

Figure 12A:
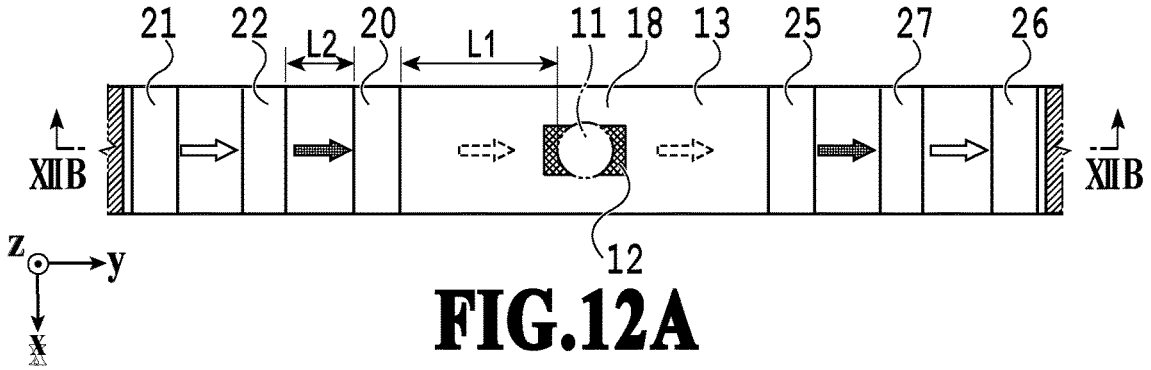
FIGS. 12A to 12D are diagrams for specifically explaining a configuration of a liquid channel and a pressure chamber in a third embodiment.
Figure 12B:
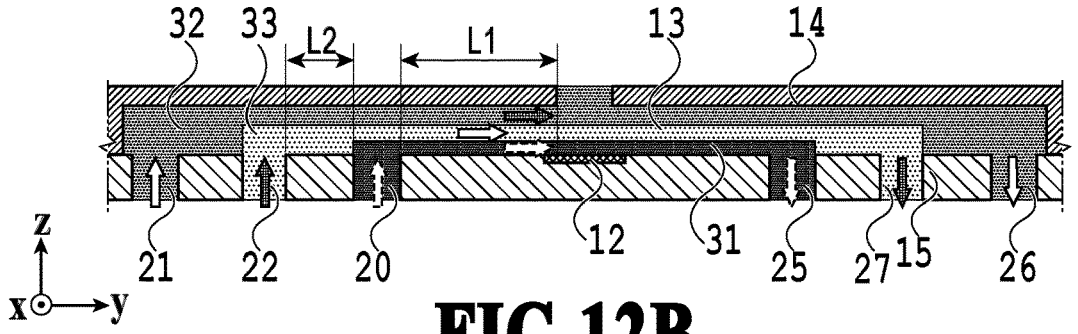
Figure 12C:
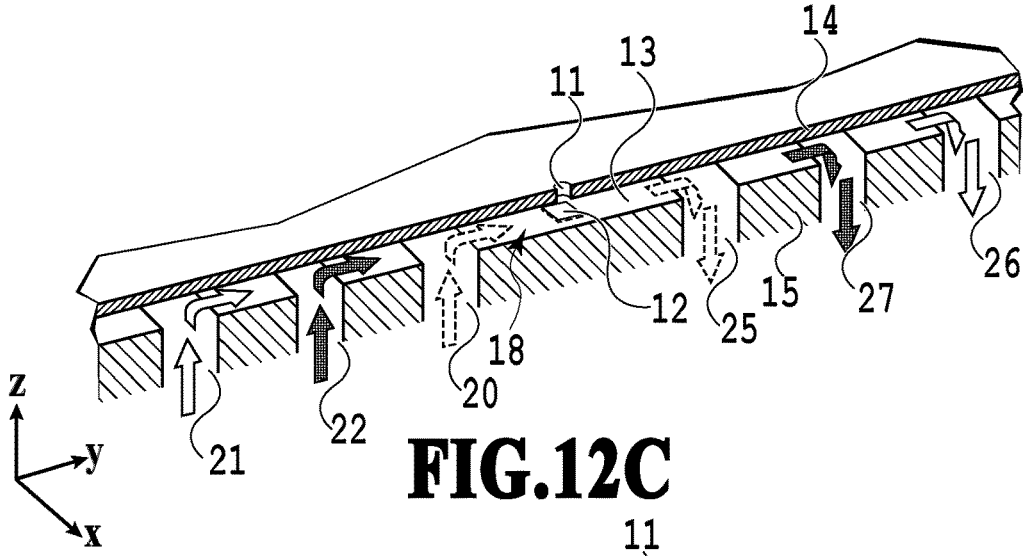

FIGS. 12A to 12D are diagrams showing a configuration of the liquid channel 13 in the present embodiment. FIG. 12B is a cross-sectional view taken along the XIIB-XIIB section line shown in FIG. 12A. The liquid channel 13 in the present embodiment differs from the liquid channel 13 described in the first embodiment in that a third liquid 33 is caused to flow through the liquid channel 13 in addition to the first liquid 31 and the second liquid 32. By causing the third liquid to flow through the liquid channel 13, it is possible to employ a bubble generation medium with a high critical pressure as the first liquid and employ inks of different colors, highly concentrated resin emulsions (EMs), or the like as the second liquid and the third liquid.

In the present embodiment, in the portion of the silicon substrate 15 corresponding to the bottom of the liquid channel 13, the second inlet port 21, a third inlet port 22, the first inlet port 20, the first outlet port 25, a third outlet port 27, and the second outlet port 26 are formed in this order in the y direction. Then, the pressure chamber 18, which contains the ejection orifice 11 and the pressure generation element 12, is disposed substantially at the midpoint between the first inlet port 20 and the first outlet port 25.

The first liquid 31 supplied into the liquid channel 13 through the first inlet port 20 flows in the y direction (the direction indicated by the broken-line arrows) and then flows out from the first outlet port 25. Also, the second liquid 32 supplied into the liquid channel 13 through the second inlet port 21 flows in the y direction (the direction indicated by the white arrows) and then flows out from the second outlet port 26. The third liquid 33 supplied into the liquid channel 13 through the third inlet port 22 flows in the y direction (the direction indicated by the black arrows) and then flows out from the third outlet port 27.

In other words, inside the liquid channel 13, the first liquid 31, the second liquid 32, and the third liquid 33 flow together in the y direction between the first inlet port 20 and the first outlet port 25. The pressure generation element 12 is in contact with the first liquid 31, the second liquid 32 around the ejection orifice 11 exposed to the atmosphere forms a meniscus, and the third liquid 33 flows between the first liquid 31 and the second liquid 32.

Figure 12D:
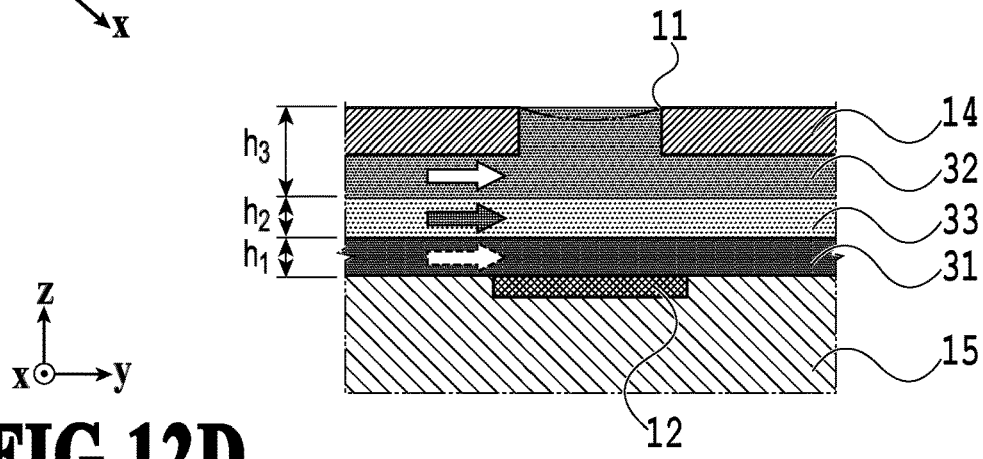

In the present embodiment, the CPU 500 controls the flow rate $Q_1$ of the first liquid 31, the flow rate $Q_2$ of the second liquid 32, and a flow rate $Q_3$ of the third liquid 33 via the liquid circulation unit 504 to steadily form three layers of parallel flows as shown in FIG. 12D. Then, the CPU 500 drives the pressure generation element 12 of the ejection head 1 with such three layers of parallel flows formed, to thereby eject a droplet from the ejection orifice 11. In this way, even in a case where an ejection operation disturbs the interface positions, the three layers of parallel flows return to a state as shown in FIG. 12D in a short time, and the next ejection operation can be started immediately.

Maintaining a fine ejection operation in the present embodiment requires three layers of stable parallel flows to be present directly under the ejection orifice 11. For this reason, in the present embodiment, the position of the first inlet port 20 relative to the ejection orifice 11 is determined such that an interface formation distance L1 from the first inlet port 20 to the ejection orifice 11 is a greater value than an interface stabilization distance Le1 for the third liquid 33 and the first liquid 31 (L1>Le1). In this way, the interface between the third liquid 33 and the first liquid 31 moves the predetermined interface stabilization distance Le1 (not shown) and reaches the ejection orifice 11 in a stable state.

Note that the position in the liquid channel 13 at which the second liquid 32 and the third liquid 33 merge is not particularly limited as long as it is upstream of the position at which the first liquid 31 merges with them. However, if the interface between the second liquid 32 and the third liquid 33 is unstable at the position at which the first liquid 31 merges with them, there is a possibility that it may be difficult to stabilize the interface between the third liquid 33 and the first liquid 31. For this reason, it is preferable that the interface between the second liquid 32 and the third liquid 33 be already stable at the position at which the first liquid 31 merges with them. Thus, in the present embodiment, the position of the third inlet port 22 is determined such that a distance L2 from the third inlet port 22 to the first inlet port 20 is a greater value than an interface stabilization distance Le2 for the second liquid 32 and the third liquid 33 (L2>Le2). In this way, the interface between the second liquid 32 and the third liquid 33 moves the predetermined interface stabilization distance Le2 (not shown) and reaches the first inlet port 20 in a stable state.

Under the above conditions, the first liquid 31, the second liquid 32, and the third liquid 33 flow through the liquid channel 13 in the present embodiment as follows. Specifically, in the middle of movement of the second liquid 32 in the y direction, the third liquid 33 flows in. After the second liquid 32 and the third liquid 33 move the predetermined interface stabilization distance Le1 (not shown), the interface therebetween becomes stable. Then, in the middle of movement of the second liquid 32 and the third liquid 33 in the y direction with the above interface maintained therebetween, the first liquid 31 flows in. After the second liquid 32, the third liquid 33, and the first liquid 31 move the predetermined interface stabilization distance Le2 (not shown), the interface between the third liquid 33 and the first liquid 31 becomes stable. As a result, three layers of parallel flows with the interface between the second liquid 32 and the third liquid 33 and the interface between the third liquid 33 and the first liquid 31 being both stable are obtained directly under the ejection orifice 11. Specifically, a droplet containing the first to third liquids in a predetermined ratio can be stably ejected from the ejection orifice 11 by a fine ejection operation.

(Specific Example of First Liquid, Second Liquid, and Third Liquid)

In the configurations of the embodiments described above, the required functions of the first liquid 31, the second liquid 32, and the third liquid 33 are clear such that the first liquid 31 is a bubble generation medium for causing film boiling, and the second liquid 32 and the third liquid 33 are ejection media to be ejected to the outside from the ejection orifice. Thus, with the configurations of the above embodiments, the degree of freedom in the components to be contained in the first liquid 31, the second liquid 32, and the third liquid 33 is higher than those in conventional techniques. The bubble generation medium (first liquid) and the ejection media (second liquid and third liquid) in such a configuration will be specifically described below by taking specific examples.

The bubble generation medium (first liquid 31) in the above embodiments is required to be such that in a case where the electrothermal converter generates heat, film boiling occurs in the bubble generation medium and the generated bubble enlarges abruptly. In other words, the bubble generation medium is required to have such a high critical pressure that enables efficient conversion of thermal energy into bubble generation energy. Water is particularly preferable as such a medium. Water, although its molecular weight is as small as 18, has a high boiling point (100° C.), a high surface tension (58.85 dyne/cm at 100° C.), and a high critical pressure of approximately 22 MPa. In other words, the bubble generation pressure for film boiling is significantly high as well. Generally, inkjet printing apparatuses of the type that performs ink ejection by using film boiling preferably use ink made of water with a color material such as a dye or pigment contained therein.

The bubble generation medium, however, is not limited to water. A medium having a critical pressure of 2 MPa or higher (preferably 5 MPa or higher) can function as the bubble generation medium. Examples of the bubble generation medium other than water include methyl alcohol and ethyl alcohol, and a mixture of water and any of these liquids can be used as the bubble generation medium as well. Also, a medium made of water with a color material such as a dye or pigment, as mentioned above, or another additive contained therein can be used as well.

The ejection media in the above embodiments (second liquid 32 and third liquid 33), on the other hand, are not required to have physical properties for causing film boiling like the bubble generation medium. Also, attachment of kogation to the top of the electrothermal converter (heater) leads to a concern that the smoothness of the heater surface may be impaired and/or the thermal conductivity may be lowered, thereby lowering the bubble generation efficiency. However, since the ejection media do not directly contact the heater, the components contained therein are unlikely to get burnt. Specifically, the ejection media have less strict physical property requirements for causing film boiling and avoiding kogation than those of conventional thermal head inks. This increases the degree of freedom in the components contained, and thus enables the ejection media to actively contain components suitable for usage after ejection.

For example, pigments that have not conventionally been used due to the reason that they get easily burnt on a heater can be actively contained in the ejection media in the above embodiments. Also, in the above embodiments, liquids other than aqueous inks with significantly low critical pressure can be used as the ejection media. Further, various inks with special functions that have been difficult to use with conventional thermal heads, such as ultraviolet curable inks, electrically conductive inks, EB (electron beam) curable inks, magnetic inks, and solid inks, can be used as the ejection media. Also, by using blood, cells in a culture liquid, and so on as the ejection media, the liquid ejection heads in the above embodiments can be used in various applications other than image formation. The liquid ejection heads in the above embodiments can be effectively used in applications such as biochip fabrication and electronic circuit printing.

In particular, a configuration in which water or a liquid similar to water is the first liquid (bubble generation medium) while pigment inks with higher viscosities than that of water are the second liquid and the third liquid (ejection media), and only the second and third liquids are ejected is one effective application of the embodiments. In such a case too, it is effective to keep the water layer thickness ratio $h_r$ low by making the flow rate ratio $Q_r=Q_2/Q_1$ as low as possible, as shown in FIG. 5A. Note that since the liquids as the ejection media are not limited, the same liquid as any of the liquids listed as the first liquid can be used. For example, in a case where each of the above liquids is an ink containing a large amount of water, it is possible to use one of the inks as the first liquid and the other ink as the second liquid depending on a situation such as the mode of use, for example.

(Example in Which Ejected Droplet Contains Mixed Liquid)

Next, a description will be given of a case where the ejected droplet 30 is ejected in a state where the first liquid 31 and the second liquid 32 or the first liquid 31, the second liquid 32, and further the third liquid 33 are mixed in a predetermined ratio. In a case where, for example, the first liquid 31 and the second liquid 32 are inks of different colors, these inks will form laminar flows inside the liquid channel 13 and the pressure chamber 18 without their colors being mixed, if the Reynolds number calculated based on both liquids' viscosities and flow rates satisfies a relationship in which the Reynolds number is smaller than a predetermined value. Specifically, by controlling the flow rate ratio $Q_r$ of the first liquid 31 and the second liquid 32 in the liquid channel and the pressure chamber, it is possible to adjust the water layer thickness ratio $h_r$ and thus the mixture ratio of the first liquid 31 and the second liquid 32 in the ejected droplet 30 to a desired ratio.

For example, in a case where the first liquid is a clear ink and the second liquid is a cyan ink (or a magenta ink), it is possible to eject light cyan inks (or light magenta inks) with various color material densities by controlling the flow rate ratio $Q_r$. Also, in a case where the first liquid is a yellow ink and the second liquid is a magenta ink, it is possible to eject various types of red inks with hues varying in a stepwise manner by controlling the flow rate ratio $Q_r$. Specifically, if it is possible to eject a droplet in which the first liquid and the second liquid are mixed in a desired ratio, then the color reproduction range to be expressed on a print medium can be made wider than conventional ranges by adjusting the mixture ratio.

Also, the configurations of the present embodiments are effective in a case where two kinds of liquids are used which are preferably not mixed until immediately before ejection and mixed immediately after ejection. For example, in image printing, there are cases where a highly concentrated pigment ink having excellent color developability and a resin emulsion (resin EM) having excellent fastness such as excellent scratch resistance are preferred to be applied to a print medium at the same time. However, the pigment component contained in the pigment ink and the solid component contained in the resin EM are prone to aggregate in a case where the distance between particles is short. Thus, the dispersiveness tends to be impaired. Then, in a case where the first liquid is a highly concentrated resin emulsion (EM) while the second liquid is a highly concentrated pigment ink and the flow speeds of these liquids are controlled to form their parallel flows, the two liquids get mixed and aggregate on a print medium after being ejected. Specifically, it is possible to maintain a preferable ejection state with the high dispersiveness and obtain an image having high color developability and excellent fastness after landing.

Note that causing two liquids to flow in the pressure chamber is effective in a case as above where mixing after ejection is to be achieved, regardless of the form of the pressure generation element. Specifically, the above embodiments function effectively even with a configuration in which critical pressure limitations and the kogation problem do not occur in the first place, such as a configuration using a piezoelectric element as the pressure generation element, for example.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2019-142443, filed Aug. 1, 2019, which is hereby incorporated by reference herein in its entirety.

What is claimed is:

1. A liquid ejection head comprising:

a liquid channel through which a first liquid and a second liquid flow;

a pressure generation element that pressurizes the first liquid; and an ejection orifice through which to eject the second liquid in a direction crossing a direction of the flow of the first liquid and the second liquid via the pressurization, wherein a distance in the direction of the flow from a position in the liquid channel at which the first liquid and the second liquid merge to the ejection orifice is greater than an interface stabilization distance in the direction of the flow from a position at which the first liquid and the second liquid contact each other to a position at which a stable interface is obtained between the first liquid and the second liquid, and wherein with Re being a Reynolds number, Af being a cross-sectional area of the liquid channel, Wp being a wetted perimeter of the liquid channel, and Le being the interface stabilization distance, the interface stabilization distance Le is calculated from the following formula:

$$Le=4Af(0.0550Re+0.379\exp(-0.148Re)+0.260)/Wp.$$

2. The liquid ejection head according to claim 1, wherein in the liquid channel, an inlet port for the second liquid, an inlet port for the first liquid, the ejection orifice, an outlet port for the first liquid, and an outlet port for the second liquid are provided in this order in the direction of the flow, and the position at which the first liquid and the second liquid merge is a position at which the inlet port for the first liquid is provided.

3. The liquid ejection head according to claim 1, wherein in the liquid channel, a merge wall is provided upstream of the ejection orifice with respect to the direction of the flow, the merge wall being a wall that causes the first liquid and the second liquid to move in the direction of the flow in a state of being separated from each other, and the position at which the first liquid and the second liquid merge is a position of a downstream end of the merge wall in the direction of the flow.

4. The liquid ejection head according to claim 3, wherein in the liquid channel, a separation wall is provided at a position downstream of the ejection orifice in the direction of the flow, the separation wall being a wall that separates the first liquid and the second liquid from each other.

5. The liquid ejection head according to claim 1, wherein the pressure generation element pressurizes the first liquid in a state where the first liquid and the second liquid are flowing.

6. The liquid ejection head according to claim 1, wherein the pressure generation element pressurizes the first liquid in a state where the first liquid and the second liquid are stopped.

7. The liquid ejection head according to claim 1, wherein the second liquid is ejected from the ejection orifice by a pressure applied through the interface between the first liquid and the second liquid by driving the pressure generation element.

8. The liquid ejection head according to claim 1, wherein a liquid ejected from the ejection orifice does not contain the first liquid.

9. The liquid ejection head according to claim 1, wherein the pressure generation element causes film boiling in the first liquid by generating heat in response to application of voltage to the pressure generation element.

10. The liquid ejection head according to claim 9, wherein the first liquid is water or an aqueous liquid having a critical pressure of 2 MPa or higher.

11. The liquid ejection head according to claim 9, wherein the second liquid is a pigment-containing aqueous ink or an emulsion.

12. The liquid ejection head according to claim 9, wherein the second liquid is an ultraviolet curable ink.

13. A liquid ejection apparatus comprising a liquid ejection head including:

a liquid channel through which a first liquid and a second liquid flow;

a pressure generation element that pressurizes the first liquid;

an ejection orifice through which to eject the second liquid in a direction crossing a direction of the flow of the first liquid and the second liquid via the pressurization;

a flow control unit that controls the flow of the first liquid and the second liquid in the liquid channel; and a drive unit that drives the pressure generation element, wherein a distance in the direction of the flow from a position in the liquid channel at which the first liquid and the second liquid merge to the ejection orifice is greater than an interface stabilization distance in the direction of the flow from a position at which the first liquid and the second liquid contact each other to a position at which a stable interface is obtained between the first liquid and the second liquid, and wherein with Re being the Reynolds number, Af being a cross-sectional area of the liquid channel, Wp being a wetted perimeter of the liquid channel, and Le being the interface stabilization distance, the interface stabilization distance Le is calculated from the following formula:

$$Le=4Af(0.0550Re+0.379\exp(-0.148Re)+0.260)/Wp.$$

14. A liquid ejection module that forms a liquid ejection head by being arrayed with one or more liquid ejection modules, comprising:

a liquid channel through which a first liquid and a second liquid flow;

a pressure generation element that pressurizes the first liquid; and an ejection orifice through which to eject the second liquid in a direction crossing a direction of the flow of the first liquid and the second liquid via the pressurization, wherein a distance in the direction of the flow from a position in the liquid channel at which the first liquid and the second liquid merge to the ejection orifice is greater than an interface stabilization distance in the direction of the flow from a position at which the first liquid and the second liquid contact each other to a position at which a stable interface is obtained between the first liquid and the second liquid, and wherein with Re being a Reynolds number, Af being a cross-sectional area of the liquid channel, Wp being a wetted perimeter of the liquid channel, and Le being the interface stabilization distance, the interface stabilization distance Le is calculated from the following formula:

$$Le=4Af(0.0550Re+0.379\exp(-0.148Re)+0.260)/Wp.$$

* * * * *